US007021096B2

(12) United States Patent
Barnett

(10) Patent No.: US 7,021,096 B2
(45) Date of Patent: Apr. 4, 2006

(54) FRONT GAUGE FOR A SHEET BENDING BRAKE

(76) Inventor: O. Lynn Barnett, 1300 Maple Grove Cir., Clinton, OH (US) 44216

( * ) Notice: Subject to any disclaimer, the term of this patent is extended or adjusted under 35 U.S.C. 154(b) by 73 days.

(21) Appl. No.: 10/813,105

(22) Filed: Mar. 30, 2004

(65) Prior Publication Data

US 2005/0086991 A1 Apr. 28, 2005

Related U.S. Application Data

(60) Provisional application No. 60/515,151, filed on Oct. 28, 2003.

(51) Int. Cl.
*B21D 5/04* (2006.01)

(52) U.S. Cl. ..... 72/31.1; 72/319

(58) Field of Classification Search ..... 72/319–321, 72/31.12, 31.1
See application file for complete search history.

(56) References Cited

U.S. PATENT DOCUMENTS

| | | | | | |
|---|---|---|---|---|---|
| 312,547 | A | * | 2/1885 | Andersen | 72/319 |
| 366,486 | A | | 7/1887 | Kimmel | |
| 404,164 | A | | 5/1889 | Buckman | |
| 627,309 | A | | 6/1899 | Reese | |
| 659,163 | A | | 10/1900 | Beaudett | |
| 873,358 | A | | 12/1907 | Emrich | |
| 1,384,814 | A | * | 7/1921 | Weaver | 72/319 |
| 2,343,441 | A | | 3/1944 | Babcock et al. | |
| 2,401,031 | A | | 5/1946 | Wanasek | |
| 2,466,685 | A | * | 4/1949 | Cole | 33/627 |
| 2,510,768 | A | * | 6/1950 | Williamson | 72/31.12 |
| 2,564,459 | A | | 8/1951 | Berkson | |
| 2,638,141 | A | * | 5/1953 | Skinner et al. | 72/31.12 |
| 3,248,921 | A | | 5/1966 | Trout | |
| 3,260,087 | A | * | 7/1966 | Guarino | 72/31.12 |
| 3,726,120 | A | * | 4/1973 | Hugert | 72/306 |
| 3,948,074 | A | | 4/1976 | Stalzer | |
| 4,512,174 | A | | 4/1985 | Rhoades | |
| 4,658,624 | A | * | 4/1987 | Ridgway et al. | 72/316 |
| 4,700,937 | A | * | 10/1987 | Naylor | 269/304 |
| 5,259,230 | A | | 11/1993 | Beyers | |
| 5,630,336 | A | | 5/1997 | Jorgenson | |
| 5,661,996 | A | | 9/1997 | Welty | |
| 5,761,939 | A | | 6/1998 | Spencer et al. | |
| 6,082,164 | A | | 7/2000 | Palmer | |
| 6,325,367 | B1 | * | 12/2001 | Russell | 269/317 |
| 6,748,783 | B1 | * | 6/2004 | Chubb et al. | 72/294 |

* cited by examiner

OTHER PUBLICATIONS

J-DAN, Tradesman™ Quick-Gauge™, Website: www.j-dan.com, as of Mar. 30, 2004, 1 web page, URL = http://www.j-dan.com/qg/%20%20Quick-Gauge2.pdf.

*Primary Examiner*—Daniel C. Crane
(74) *Attorney, Agent, or Firm*—Dwight A. Stauffer

(57) ABSTRACT

A method, a front gauge and a sheet bending brake with a front gauge providing a scale for gauging a workpiece of sheet material, and optionally also for supporting the workpiece and/or squaring or angling the workpiece relative to a bending anvil of the brake. Mounting, either front mounting on a bending member or under-mounting below the brake, connects the scale to the brake, preferably removably and repositionably, such that the scale extends in front of the brake and under the workpiece, thereby enabling simple and efficient one-operator use without interfering with brake operation. The mounting also provides means for removably and repositionably attaching accessories such as a workpiece support and a workpiece rack.

46 Claims, 10 Drawing Sheets

FRONT GAUGE FOR A SHEET BENDING BRAKE

CROSS-REFERENCE TO RELATED APPLICATIONS

This application claims the benefit of U.S. Provisional Patent Application No. 60/515,151 by O. Lynn Barnett, filed Oct. 28, 2003.

TECHNICAL FIELD OF THE INVENTION

The present invention is directed to sheet bending brakes, and more particularly to a gauge for measuring sheet material to be bent or cut in a sheet bending brake.

BACKGROUND OF THE INVENTION

Sheet bending brakes generally comprise an elongated bottom member carried in a fixed position on a frame and having an upper clamping surface; an elongated top member with a lower clamping surface, the top member being vertically movable on the frame toward and away from the bottom member for clamping sheet material between the clamping surfaces and having a bending anvil along a front edge; and an elongated bending member mounted beneath a front edge of the bottom member and pivotal upwardly to bend clamped sheet material (typically sheet metal) over the bending anvil. The frame typically comprises an interconnected series of flattened C-shaped members that open frontward and hold the top and bottom members at corresponding top and bottom lips of the C-shape. Sheet bending brakes of this character are well known, and many are designed to be portable so that they can be transported for use at temporary work sites, typically to be set up on sawhorses or the like. Therefore such brakes must be rugged, and any accessories must likewise be rugged and also capable of being quickly and easily assembled and disassembled if the accessories protrude from the main body of the brake.

Present sheet bending brakes are generally available with member lengths from 6.5–14.5 feet, for example. An approximately U-shaped handle is typically provided on top for actuating the clamping/unclamping action of the top member. Similarly, a pair of straight rods, or more typically a U-shaped handle, hangs downward from the bending member such that an operator can reach down, grasp the handle, and pivotingly lift it to bend clamped sheet material over the bending anvil. The sheet material is commonly 24" wide, possibly supplied from a coil or roll, and as a "workpiece" the sheet material extends forward out away from the top and bottom clamping members. A single operator must align a desired bending line of the sheet material (workpiece) with the bending anvil, then both support and hold in position the sheet material with one hand while reaching over to close the clamp. Then the operator must reach down and pull up the bending member handle, possibly while still supporting the sheet material with one hand. Therefore, a problem associated with conventional sheet bending brakes is providing support for the sheet material extending in front of the brake. Particularly for longer pieces of sheet material, an assistant to the operator may be needed, but of course this adds to labor costs.

Another problem associated with conventional sheet bending brakes lies in squaring sheet material with respect to the bending anvil as the sheet material is inserted into the brake. That is, it is generally desired that bends or cuts in the sheet material made with the assistance of the sheet bending brake be square and parallel to an edge of the sheet material and to each other. Making the cuts or bends square to the material edge can be a time-consuming operation, resulting in undesirable expense and scrap.

Another problem with conventional sheet bending brakes is the labor and expense associated with formation of compound bends (including hems) in the sheet material when forming building trim elements and the like. For example, it is conventional practice to employ a ruler or scale to make marks at the ends of a length of sheet material, and to use these opposed marks in an effort not only to square the sheet material in the bending brake but also to locate the positions of the desired bends or cuts. For compound bends, marks may need to be made on both sides of the sheet. Another conventional technique is to employ a small strip of material, such as scrap material, to form the desired contour or profile of the trim element, including multiple bends and hems as desired. When the strip has been bent to a satisfactory contour, it is then flattened again in such a way that the stresses imparted to the strip material at each bend are plainly visible as marks on the flattened strip, thereby generating a "template strip". The template strip is then placed in turn along each end of the sheet of material to be contoured, and manual cutters or snips are used to mark the longitudinally spaced material ends at lateral positions at which the material sheet is to be bent or cut. After the sheet is bent and cut, the ends having the snip marks usually must be trimmed off. It is self evident that this is a time-consuming and expensive operation that undesirably increases the costs of building construction.

Another problem with conventional sheet bending brakes is encountered in work situations that call for "mass production", i.e., making the same bend or set of compound bends in multiple pieces of sheet material. Easily adjustable and accurately settable gauges and other aids or accessories could significantly improve an operator's efficiency in such situations.

U.S. Pat. No. 6,082,164 (Palmer; 2000) discloses a method and apparatus for supporting and positioning a workpiece in relation to a machine, the disclosed machine embodiment being a sheet bending brake. The apparatus includes an edge guide against which an edge of the workpiece is placed; and a horizontally swinging support structure for supporting the edge guide for swinging movement in a plane to adjust the edge guide's distance from the machine, and for maintaining the edge guide in a generally parallel orientation relative to the machine as the edge guide is swung to and from the machine. The method includes placing the edge of the workpiece against the edge guide so that the workpiece is in the parallel orientation relative to the machine; and swinging the edge guide to adjust its distance from the machine so that the workpiece will be in a desired position relative to the machine when the workpiece's edge is against the edge guide. The apparatus is attached to the front of the bending member, and is collapsed against the bending member before the bending member is lifted. As disclosed, the support structure is mounted at a lower elevation than the clamping surface, therefore an auxiliary elongate member (66) is swingingly secured to the first elongate member in order to provide an elevated guiding surface (74). The '164 apparatus does not appear to provide a scale for measuring workpiece width, and the support structure cannot be fixed at a predetermined workpiece width for duplicating widths on multiple workpieces. Although the description briefly discusses providing an edge guide with a different, predetermined but non-parallel orientation relative to the brake, it is not disclosed how this would be implemented, and whether the non-parallel angle could be easily changed to different, known angles as desired.

U.S. Pat. No. 5,761,939 (Spencer et al.; 1998) discloses an automatic indexer for a sheet bending brake (30), wherein the indexer (e.g., 62) functions to square sheet material with respect to the bending anvil (46) as the sheet material is inserted into the brake between top and bottom members (38, 42), and to measure (gauge or index) the amount of material inserted into the brake with respect to the anvil edge. The indexer is a "back gauge", being fixedly mounted inside the brake, i.e., behind the top and bottom members, preferably being affixed to one or more C-shaped members (e.g., 34). Two functionally equivalent indexer embodiments are disclosed: a first indexer (62) is adapted to be assembled as a permanent part of a sheet bending brake (30) at the time of original manufacture, whereas a second indexer (100) is adapted to be provided as a separate construction for mounting to a sheet bending brake (30) as an add-on in the aftermarket. The indexer (e.g., 62) includes a pair of slides (e.g., 76) having means for mounting the slides parallel to each other and spaced from each other lengthwise of the clamping surface on the bending brake. A pair of carriages (e.g., 78) are each slidably disposed on one of the slides, and a bar (e.g., 84) extends longitudinally between the carriages and parallel to the clamping surface for engagement with an edge of sheet material inserted between the top and bottom members of the sheet bending brake. The carriages are resiliently biased (e.g., springs 80) toward the clamping surface of the sheet bending brake, and means are coupled to the carriages for relating distance between the anvil to the edge of sheet material in engagement with the bar. This distance is either a direct measure to the edge of the anvil for forming indexed bends, or an offset distance with respect to the anvil for indexing the sheet material for a cut employing a manual slitter that cuts the material at a predetermined offset distance from the anvil edge. Thus, the indexer automatically squares the cut or bend to the edge in engagement with the indexer, and automatically positions the bend or cut with respect to the anvil edge as controlled by the indexer. In a first embodiment, the indexer (66) includes a bracket (90) that extends laterally from each carriage (78) over lateral slots (72, 74) in which are placed a scale (92) and optionally a template strip (98'), such that an edge of each bracket (90) may be employed in conjunction with the scale and/or template strip for indexing sheet material workpieces for cutting or bending. At least one carriage (78) has a lateral opening that receives a threaded shaft coupled to a handle (96) that may be rotated to bring the threaded shaft into engagement with the slide rod (76) for locking the carriage in position.

It can be seen that the indexer (back gauge) of Spencer et al. '939 has various problems. The scale is hard to read inside the brake, particularly for an operator standing on the other side of a wide piece of sheet material. For like reasons, the handle locking the carriage in position is awkward and/or difficult to use, therefore the spring biasing must be pressed against by the sheet material while the clamping members are clamped on the material. If thinner sheet material is being used, then the material will buckle, leading to inaccuracies in measurement by the indexer. Finally, additional means must be provided if support is desired for the sheet material extending out in front of the brake.

Thus there is a need for a scale/gauge/indexer that extends forward from the brake (i.e., a "front gauge"), preferably one that provides support for the workpiece, that does not put spring force on the workpiece, and is otherwise simple and efficient for one-operator usage. A further problem that must be addressed by any front gauge is how to avoid interfering with the bending of the workpiece by the upward-pivoting bending member.

The J-Dan Company of Romulus, Mich. presently offers a front mounted gauge that is sold under the trademarks of TRADESMEN™ Quick-Gauge™ and described in their sales literature (see their website wwwj-dan.com) as having "U.S. and Foreign patents pending". As best as can be determined from the photographs and text in their literature, the Quick-Gauge™ front gauge comprises a pair of gauges that hook onto the outside front of a Tradesmen™ brake's top jaw. Two "tape measure" scales are visible on top of each gauge (one for cutting and one for bending, etc.), and an adjustable stop with a thumbscrew style of set screw slides in-out over the scales for gauging predetermined widths of sheet material. It can be seen that the sheet material must be held up under the gauge(s) while the brake is clamped on the sheet material, and then the gauge(s) must be removed before the material can be cut or bent upward. Apparent problems include the following. Since the stop is not very wide, two gauges must be employed in order to assure squaring the material to the brake. If an operator is holding the material up against two gauges, then an assistant may be needed to provide a third hand for clamping the brake. When relatively thin and wide sheet material is being gauged, the material will tend to sag under its own weight, leading to inaccurate gauging. Similarly, if the operator pushes upward too hard while supporting the sheet material, then the gauge(s) can be lifted up, also leading to inaccurate gauging. Finally, the forgoing problems combined with the inconvenience of removing and re-applying the gauges for each bend or cut contribute to significant inefficiency of operation as well as a disincentive for use of the Quick-Gauge™ front gauge(s).

Concerning accessories for sheet bending brakes, U.S. Pat. No. 4,512,174 (Rhoades; 1985) discloses a combined sheet bending brake and platform wherein the platform is for supporting a set-aside piece of sheet material without interfering with the operation of the brake on another piece. The platform (60) comprises a tubular bar that is U-shaped and has spaced arms (61) connected by cross-portion (62). The free end of each arm extends through longitudinally-spaced openings (63, 64) in a rear rail (16) portion of the brake's frame. The arms are telescopically received in the rear rail so that the platform can be stored by shifting the arms so that they extend within the confines of the front and rear rails of the frame. The platform can be extended by pulling outwardly (rearward). Locking pins (67) fitted into holes in the arms are provided to hold the platform in, extended or retracted. Also mentioned is an "adjustable stop" (53) comprised of a flange (42) on a track receiving a C-shaped portion (54) having a downwardly extending portion (56) such that the stop can be moved along the track and held in position by a thumb screw (55), thereby providing a stop for adjusting a sheet in proper position for bending. There is no mention of a scale for the disclosed back stop that therefore appears to be an elementary form of back gauge.

A forward extending support is offered by the Tapco Products Company (Plymouth, Mich.) as seen in their 2003 Integrated Tool Systems Full Product Line Catalog. The "Port-O-Bender® Table" is a removable accessory table for added accuracy and support with heavy metals. As best as can be determined from the catalog photographs, the table is a relatively small, flat, unmarked rectangular surface that is mounted out in front of the bending member such that the long axis of the rectangle extends longitudinally. The table is mounted on an L-shaped support bracket wherein the long leg of the "L" is horizontal and extends outward from underneath the brake, and the short leg rises upward to hold up the table. The long leg is removably attached under the brake by two hooks apparently sliding on the long leg: one hook being rear-opening for sliding rearward to hook up and around a rear frame rail; and the other hook being front-opening for sliding frontward to hook up and around a front frame rail of the brake. Manual positioning of the sliding hooks provides arbitrary outward positioning of the table such that a cutter can pass between the table and the front of the brake.

Other prior art includes the following.

U.S. Pat. No. 5,661,996 (Welty; 1997) discloses a back gage for a bending brake. The back gauge broadly comprises a movable carriage assembly arranged on the bed of the bending brake, a motorized drive assembly for moving the carriage assembly relative to the brake edge of the bending brake, and a measuring device (e.g., a retractable tape measure or a digital readout) mounted to the bed of the bending brake and coupled to the movable carriage assembly. The Welty '996 back gage appears to be most suitable for heavier, fixed-location brakes such as those generally used in machine shops.

Other manually adjusted back gauges are disclosed in U.S. Pat. No. 873,358 (Emrich; 1907), U.S. Pat. No. 627,309 (Reese; 1899), U.S. Pat. No. 404,164 (Buckman; 1889), and U.S. Pat. No. 366,486 (Kimmel; 1887). They all suffer the limitations of back gauges discussed hereinabove.

Thus there is a need for an easy-to-use gauge for a sheet bending brake that avoids the problems and limitations of the prior art. It is an object of the present invention to provide a front gauge that squares and supports a workpiece while establishing an easily settable gauge of workpiece width to the bend point. It is a further object to provide a front gauge that does not apply force to the workpiece while it is being gauged. It is a further object to provide a front gauge that conveniently avoids interfering with operation of the bending member and its activating handle or handles. It is a further object to provide a front gauge that can be easily removed and accurately re-applied to enhance portability of the bending brake. It is a further object to provide a front gauge that is universally adaptable for mounting (preferably removable mounting) on the majority of commercially available bending brakes. It is a further object to provide additional features and accessories that significantly improve an operator's efficiency in mass production situations involving repeated bends in multiple workpieces. Other objects of the invention may become apparent in light of the following description.

BRIEF SUMMARY OF THE INVENTION

According to the invention, a front gauge for a sheet bending brake is disclosed, wherein the brake comprises a first longitudinally extending member forming a clamping surface, a second longitudinally extending member positioned over the first member and movable toward and away from the first member for clamping a sheet material workpiece against the clamping surface and having a longitudinal front edge forming a bending anvil, and a third longitudinally extending member pivotally mounted to the first member for bending over the bending anvil a workpiece that is clamped between the first and second members; wherein the brake is operable in any orientation and, regardless of orientation, "over" is defined to mean on the second member's side of the workpiece and "under" is defined to mean on the first member's side of the workpiece; the front gauge comprising: a scale for gauging that extends outward from the front of the sheet bending brake; and mounting that connects the scale to the brake such that the scale is positioned under the workpiece.

According to the invention, the front gauge further comprises front mounting wherein the mounting comprises a bracket that attaches the scale to the third member. Further according to the invention, the mounting comprises removable attachment of the bracket to the third member, the removable attachment comprising: an open-ended track that extends longitudinally along at least a portion of the longitudinal extent of the third member; and a slider affixed to the bracket and slidably retainable by the track. Optionally, the mounting further comprises: a level-surfaced adapter affixed between the track and the third member; and a sliding support between the bracket and a suitable one of the track or the adapter or the third member.

Alternatively according to the invention, the front gauge further comprises under-mounting wherein the mounting comprises a support bar that passes under the first and third members such that a first end of the support bar is attached to the scale, and an opposed second end of the support bar is attached to a frame portion of the brake. Preferably the mounting further comprises removable attachment of the support bar to the frame portion, the removable attachment comprising: at least one square tube coupling that is affixed under the frame portion and extends laterally, the at least one coupling being sized for slidably engaging with the second end of the support bar; at least one manually tightenable set screw in a threaded hole through the coupling; and a base connecting the first end of the support bar to the scale. Preferably the mounting further comprises at least one mounting plate for affixing the at least one coupling to front and rear rails of the frame portion of the brake. Preferably the mounting further comprises a stop plate affixed on the support bar near the second end such that the stop plate abuts against the at least one coupling when the support bar is slidably engaged with the at least one coupling and is positioned at a predetermined position. Preferably the scale comprises a body that is slidably connected to the base; a spring is connected between the body and the base so as to bias the body inward against the third member; and optionally a cam plate is adjustably affixed to the third member and located at least between the body and the third member; and a bottom portion of the cam plate extends under and rearward of the third member when the third member is in an at-rest position. Also optionally, the front gauge further comprises: a lockout pin; and first and second holes for the lockout pin wherein the first hole passes through the body and the second hole passes through the base such that the second hole is aligned with the first hole when the body is slid outward to a predetermined offset distance from the brake.

According to the invention, the scale further comprises any combination of one or more gauging indicators including: ruled markings that indicate distance outward from the bending anvil; ruled markings that indicate distance inward from a zero point that is a predetermined distance outward from the bending anvil; an erasable temporary marking surface with hand made marks; and a template strip. Preferably the scale further comprises a gauge bar with at least one scale groove or scale recess for removably and adjustably retaining a selected one of the gauging indicators.

According to the invention, the front gauge further comprises a stop that is slidingly connected to the scale for sliding in and out, preferably further comprising a manually tightenable set screw in the stop, and preferably the stop further comprises a stop face that is normal to the scale, and that extends both over and under the scale. Preferably the front gauge further comprises a rotatable connection of the stop to the scale; an angle scale that indicates degrees of rotation of the stop, and optionally a stop face that is normal to the scale, and that extends both over and under the scale.

According to the invention, a method for gauging a workpiece of sheet material in a sheet bending brake is disclosed, wherein the brake comprises a first longitudinally extending member forming a clamping surface, a second longitudinally extending member positioned over the first member and movable toward and away from the first member for clamping the workpiece against the clamping surface and having a longitudinal front edge forming a bending anvil, and a third longitudinally extending member pivotally mounted to the first member for bending over the bending anvil a workpiece that is clamped between the first and second members; wherein the brake is operable in any orientation and, regardless of orientation, "over" is defined to mean on the second member's side of the workpiece and "under" is defined to mean on the first member's side of the workpiece; the method comprising the step of: mounting a scale for gauging in front of the brake such that a supporting surface of the scale is in the same plane as the clamping surface of the first member.

According to the invention, the method further comprises the step of attaching the scale such that it is longitudinally slidable and/or removable.

According to the invention, the method further comprises the step of providing front mounting that attaches the scale to the third member. Preferably the method further comprises the step of providing one or more accessories that can be attached to the brake by the front mounting. Preferably the one or more accessories are workpiece supports.

According to the invention, the method further comprises the step of providing under-mounting that attaches the scale to a frame portion of the brake under the first and third members. Preferably the method further comprises the steps of: spacing a plurality of universal mount couplings longitudinally along the brake; and using the plurality of universal mount couplings for removably attaching the one or more scales to the frame portion of the brake. Preferably the method further comprises the step of providing one or more accessories that can be removably attached to the brake by the universal mount couplings. Preferably the one or more accessories are selected from the group consisting of a workpiece rack and a workpiece support. Preferably the method further comprises the steps of: biasing the scale against the third member; and adapting the third member such that it causes the scale to slide outward in response to pivoting movement of the third member, thereby providing dynamic offset of the scale relative to the bending anvil. Optionally, the method further comprises the step of extending a U-shaped handle of the third member for allowing the handle to pass around the scale during pivoting movement of the third member.

According to the invention, the method further comprises the step of providing a static offset of the scale relative to the bending anvil.

According to the invention, the method further comprises the steps of: providing at least one gauging indicator for the scale; and providing a gauge bar with at least one scale groove or scale recess for removably and adjustably retaining a selected one of the at least one gauging indicators.

According to the invention, the method further comprises the step of providing at least one gauging indicator that comprises ruled markings that indicate distance inward from a zero point that is a predetermined distance outward from the bending anvil.

According to the invention, the method further comprises the step of providing at least one gauging indicator that comprises an erasable temporary marking surface with hand made marks.

According to the invention, the method further comprises the step of mounting the scale with attachments that are adjustable for aftermarket adaptation to different brakes.

According to the invention, the method further comprises the step of fixing an edge of the workpiece at a predetermined angle relative to the bending anvil by pressing the workpiece outward against a stop face that is slidably attached to the scale such that the stop face extends both over and under the scale in directions normal to the supporting surface of the scale. Preferably the method further comprises the step of rotatably attaching the stop face to the scale.

According to the invention, a sheet bending brake with a gauge for gauging a sheet material workpiece in the brake is disclosed, wherein the brake comprises a first longitudinally extending member forming a clamping surface, a second longitudinally extending member positioned over the first member and movable toward and away from the first member for clamping a sheet material workpiece against the clamping surface and having a longitudinal front edge forming a bending anvil, and a third longitudinally extending member pivotally mounted to the first member for bending over the bending anvil a workpiece that is clamped between the first and second members; wherein the brake is operable in any orientation and, regardless of orientation, "over" is defined to mean on the second member's side of the workpiece and "under" is defined to mean on the first member's side of the workpiece; the brake further comprising: at least one scale for gauging that extends outward from the front of the sheet bending brake; and mounting that connects the at least one scale to the brake such that the at least one scale is positioned under the workpiece.

According to the invention, the brake further comprises front mounting wherein the mounting comprises a bracket that attaches a one of the at least one scales to the third member. Further according to the invention, the mounting comprises removable attachment of the bracket to the third member, the removable attachment comprising: an open-ended track that extends longitudinally along at least a portion of the longitudinal extent of the third member; and a slider affixed to the bracket and slidably retainable by the track. Optionally, the mounting further comprises: a level-surfaced adapter affixed between the track and the third member; and a sliding support between the bracket and a suitable one of the track or the adapter or the third member. Optionally, the brake further comprises one or more workpiece supports attached to the third member by the front mounting.

Alternatively according to the invention, the brake further comprises under-mounting wherein the mounting comprises a support bar that passes under the first and third members such that a first end of the support bar is attached to a one of the at least one scales, and an opposed second end of the support bar is attached to a frame portion of the brake. Preferably the mounting further comprises removable attachment of the support bar to the frame portion, the removable attachment comprising: at least one square tube coupling that is affixed under the frame portion and extends laterally, the at least one coupling being sized for slidably engaging with the second end of the support bar; at least one manually tightenable set screw in a threaded hole through the at least one coupling; and a base connecting the first end of the support bar to the one of the at least one scales. Preferably the mounting further comprises at least one mounting plate for affixing the at least one coupling to front and rear rails of the frame portion of the brake. Optionally, the brake further comprises one or more accessories that are removably attached to the frame portion of the brake using the at least one couplings. Preferably each one of the one or more accessories is selected from the group consisting of a workpiece rack and a workpiece support. Further preferably, the workpiece rack comprises one or more vertical posts positioned rearward of the brake, each of which is affixed to a forward extending support bar at the bottom, and to at least one forward extending arm above, such that the support bar is slidably engagable with a selected one of the at least one couplings; and the workpiece support comprises a forward extending support bar affixed to a top surface that is in the same plane as the clamping surface of the first member, and the support bar is slidably engagable with a selected one of the at least one couplings. Preferably, the mounting further comprises a stop plate affixed on the support bar near the second end such that the stop plate abuts against the at least one coupling when the support bar is slidably engaged with the at least one coupling and is positioned at a predetermined position; each one of the at least one scales comprises a body that is slidably connected to the base; a spring is connected between the body and the base so as to bias the body inward against the third member; a cam plate is adjustably affixed to the third member and located at least between the body and the third member; a bottom portion of the cam plate extends under and rearward of the third member when the third member is in an at-rest position; and first and second holes and a lockout pin fitting therethrough are provided wherein the first hole passes through the body and the second hole passes through the base such that the second hole is aligned with the first hole when the body is slid outward to a predetermined offset distance from the brake. Optionally the brake further comprises a handle extension for extending a U-shaped handle on the third member such that during pivoting movement of the third member, the extended U-shaped handle can pass around a scale that is under-mounted within the span of the extended U-shaped handle.

According to the invention, each one of the at least one scales of the brake further comprises any combination of one or more gauging indicators including: ruled markings that indicate distance outward from the bending anvil; ruled markings that indicate distance inward from a zero point that is a predetermined distance outward from the bending anvil; an erasable temporary marking surface with hand made marks; and a template strip. Preferably each one of the at least one scales further comprises a gauge bar with at least one scale groove or scale recess for removably and adjustably retaining a selected one of the gauging indicators.

According to the invention, the brake further comprises: a stop that is slidingly connected to a one of the at least one scales for sliding in and out; a manually tightenable set screw in the stop; and a stop face that is normal to the one of the at least one scales, and that extends both over and under the one of the at least one scales. Preferably the brake further comprises: a rotatable connection of the stop to the one of the at least one scales; and an angle scale that indicates degrees of rotation of the stop.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar (including identical) elements may be referred to with similar numbers in a single drawing. For example, each of a plurality of elements collectively referred to as 199 may be referred to individually as 199*a*, 199*b*, 199*c*, etc. Or, related but modified elements may have the same number but are distinguished by primes. For example, 109, 109', and 109" are three different elements which are similar or related in some way, but have significant modifications, e.g., a tire 109 having a static imbalance versus a different tire 109' of the same design, but having a couple imbalance. Such relationships, if any, between similar elements in the same or different figures will become apparent throughout the specification, including, if applicable, in the claims and abstract.

Figure 1:
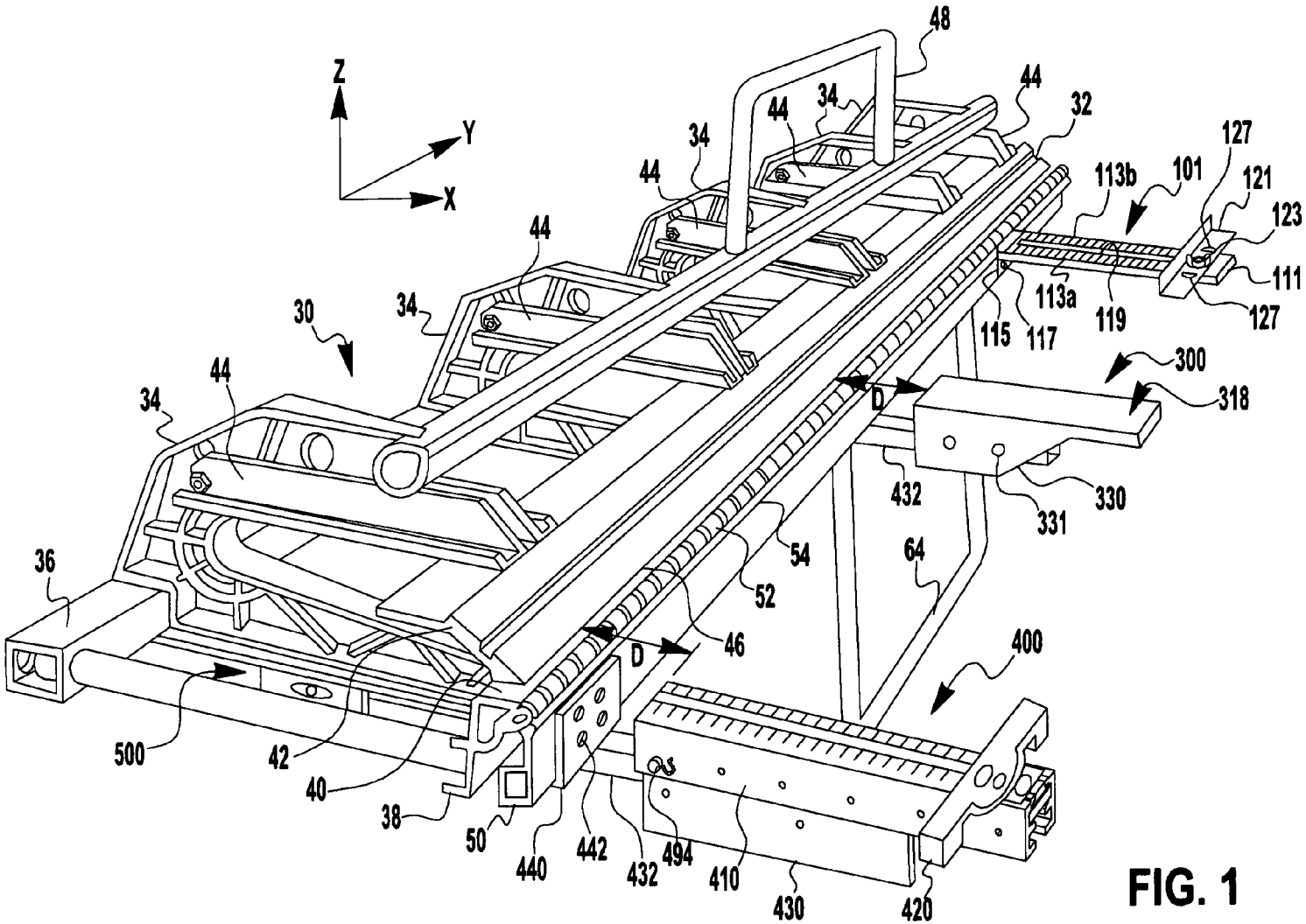
Figure 2A:
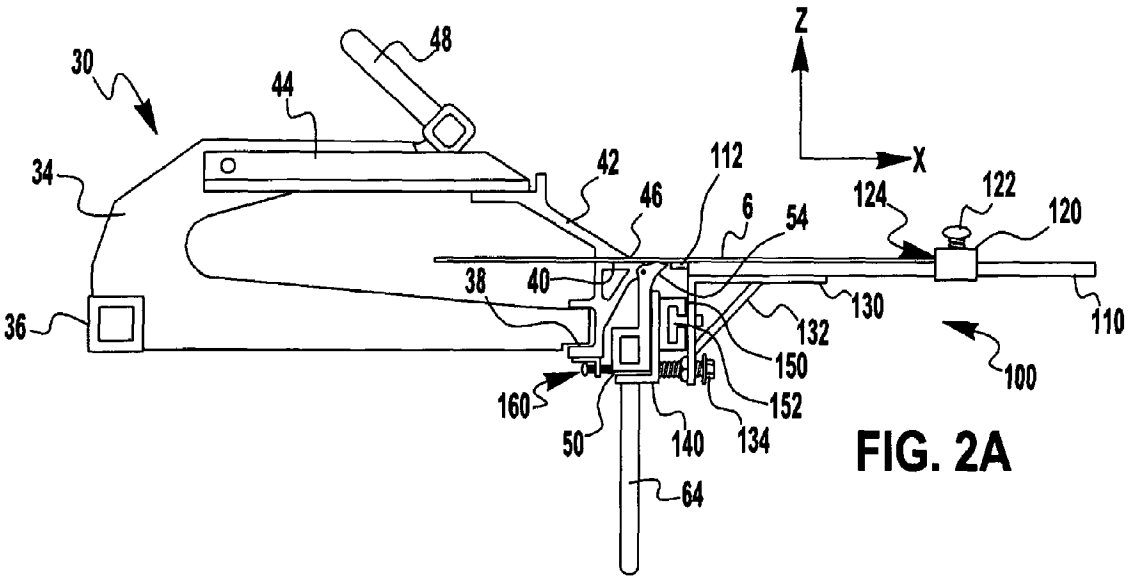
Figure 2B:
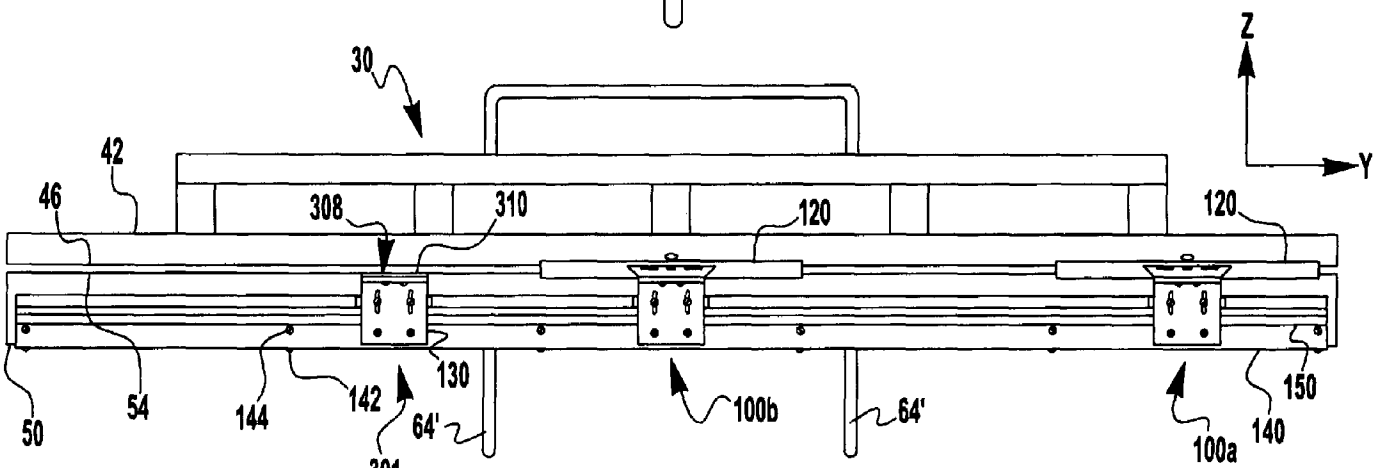
Figure 2C:
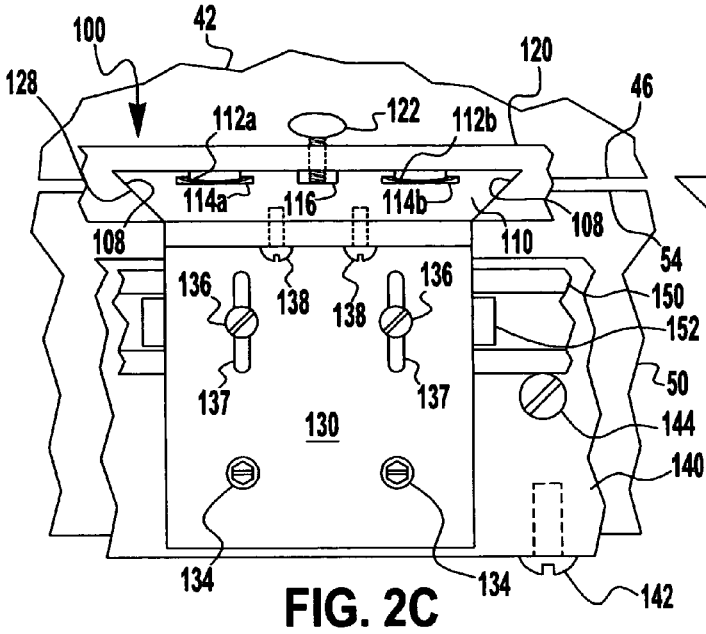
Figure 2D:
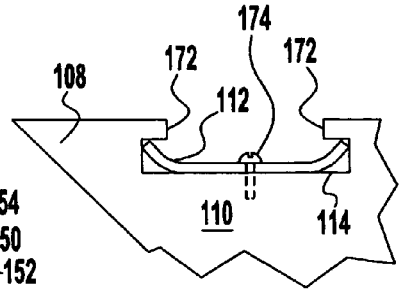
Figure 2F:
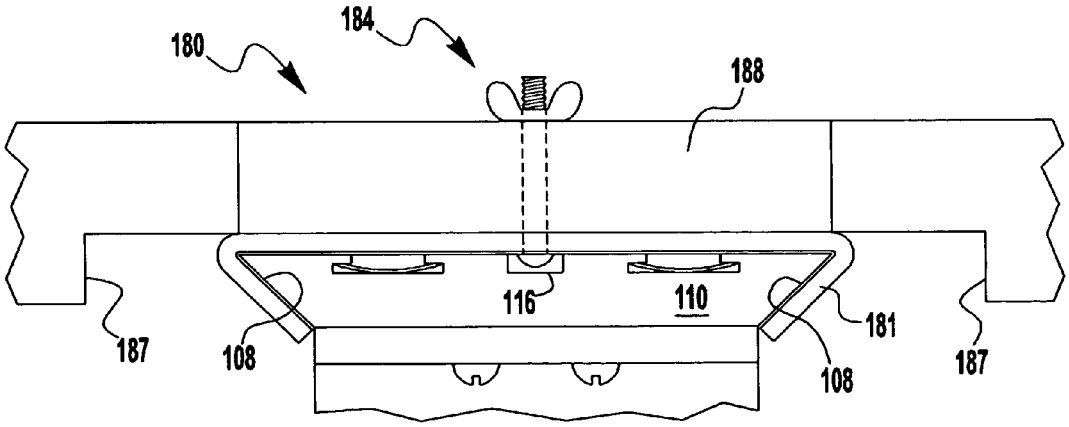
Figure 2E:
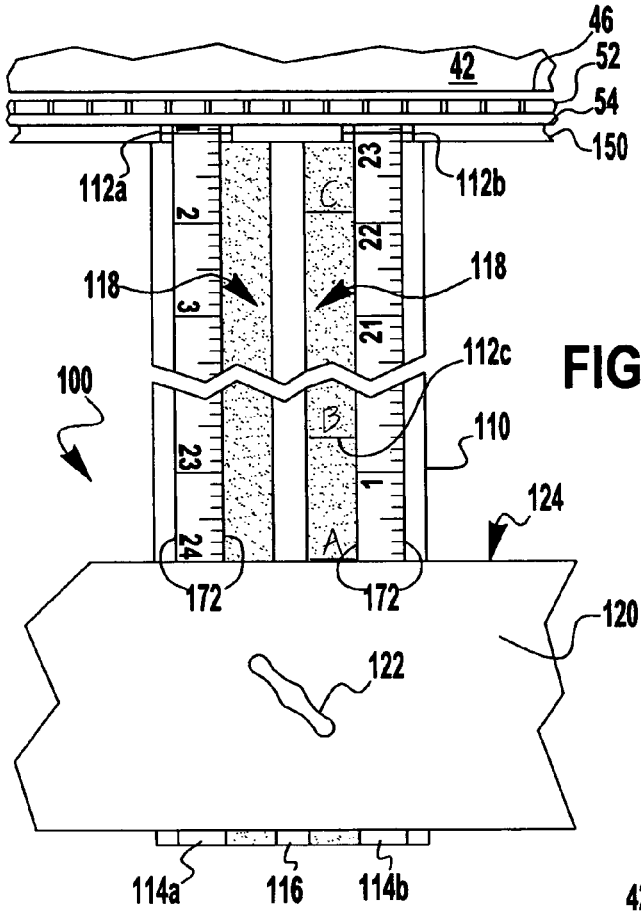
Figure 3B:
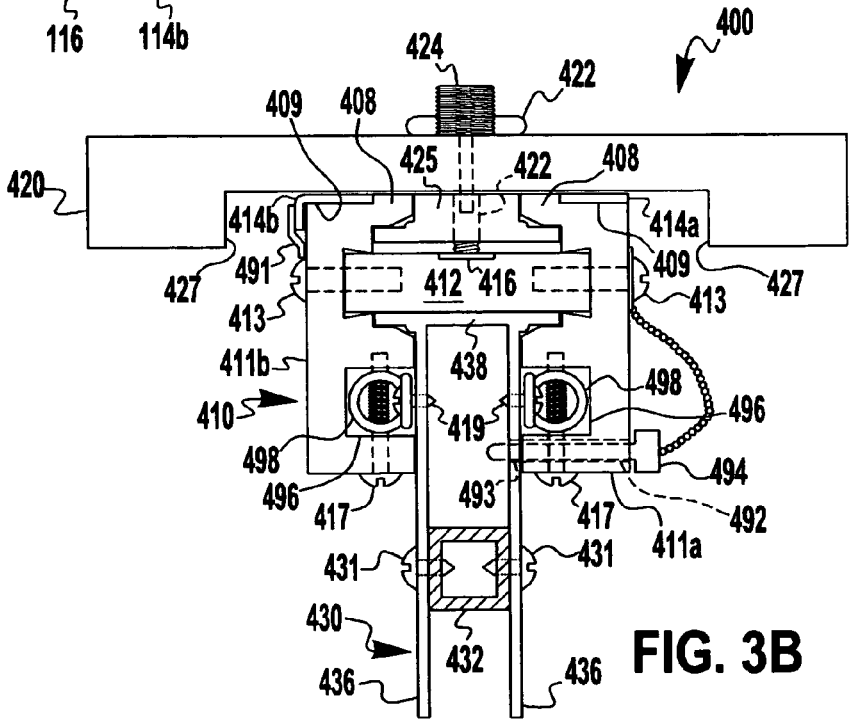
Figure 3A:
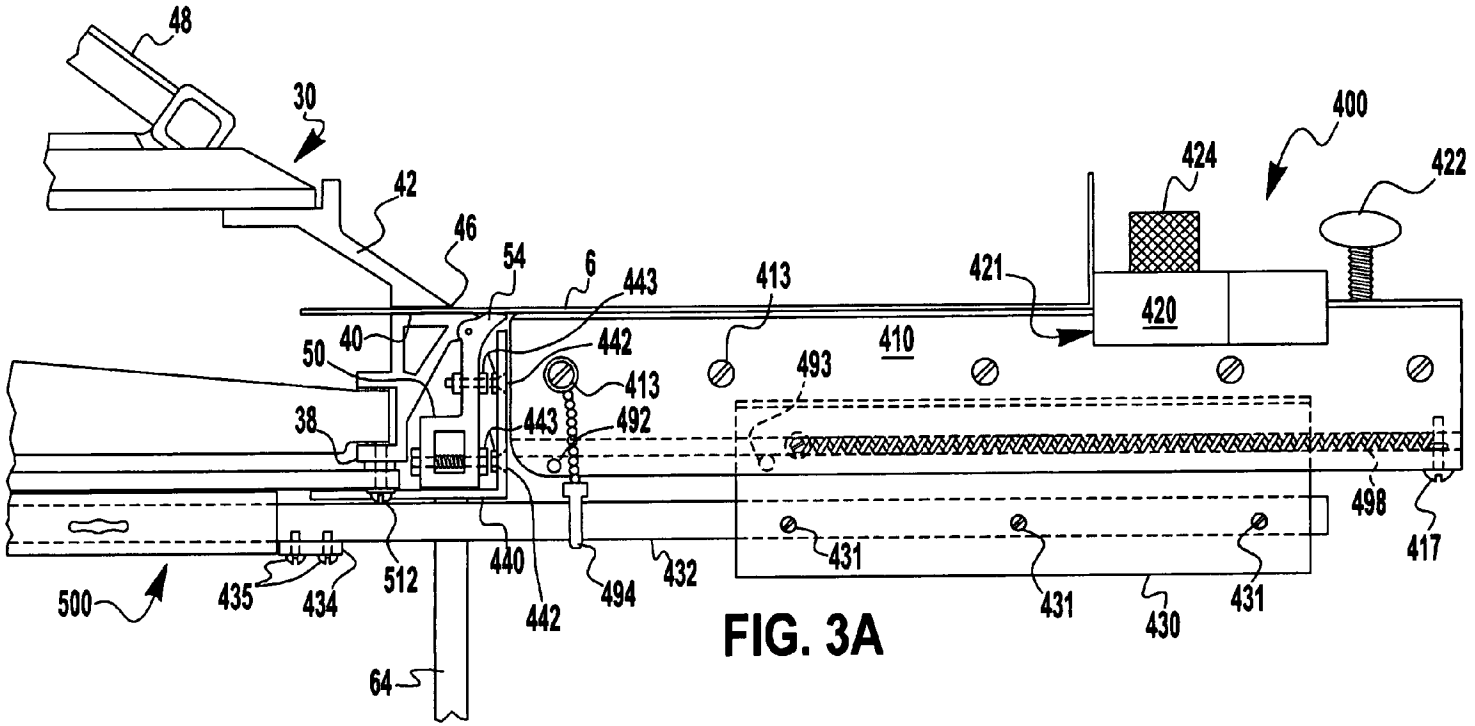
Figure 5C:
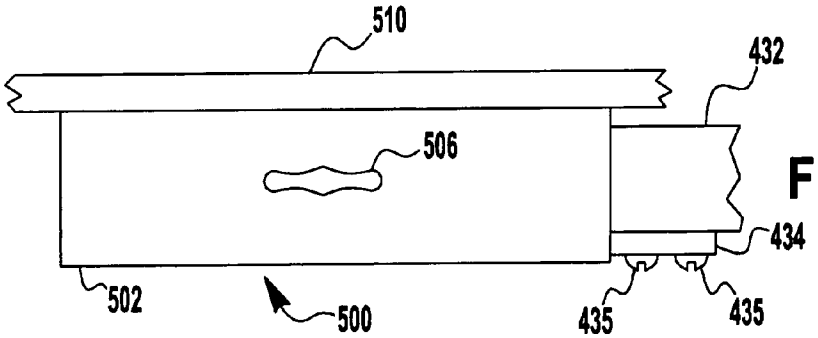
Figure 3C:
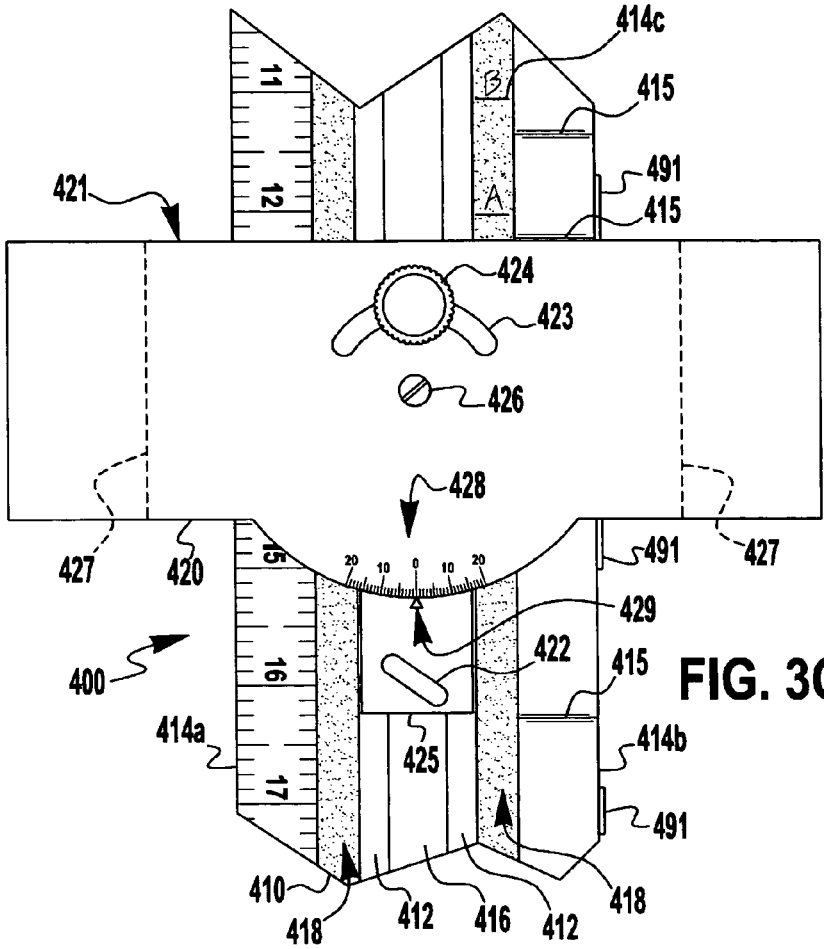
Figure 5E:
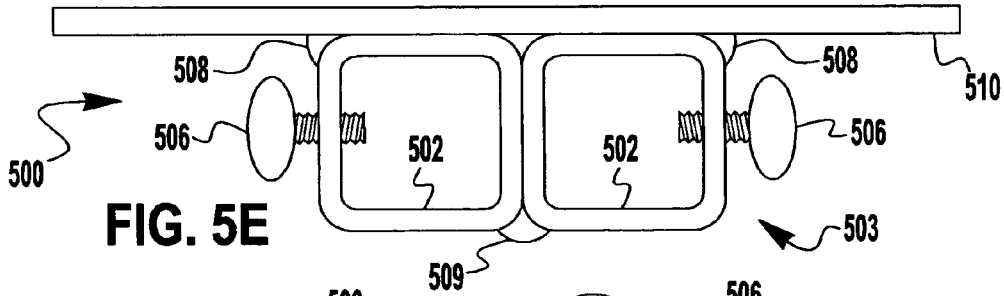
Figure 5B:
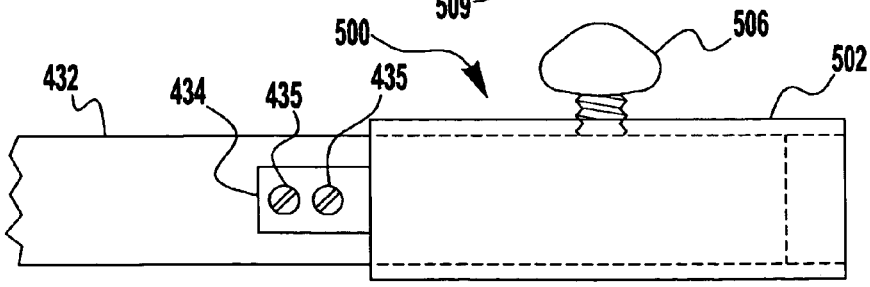
Figure 4:
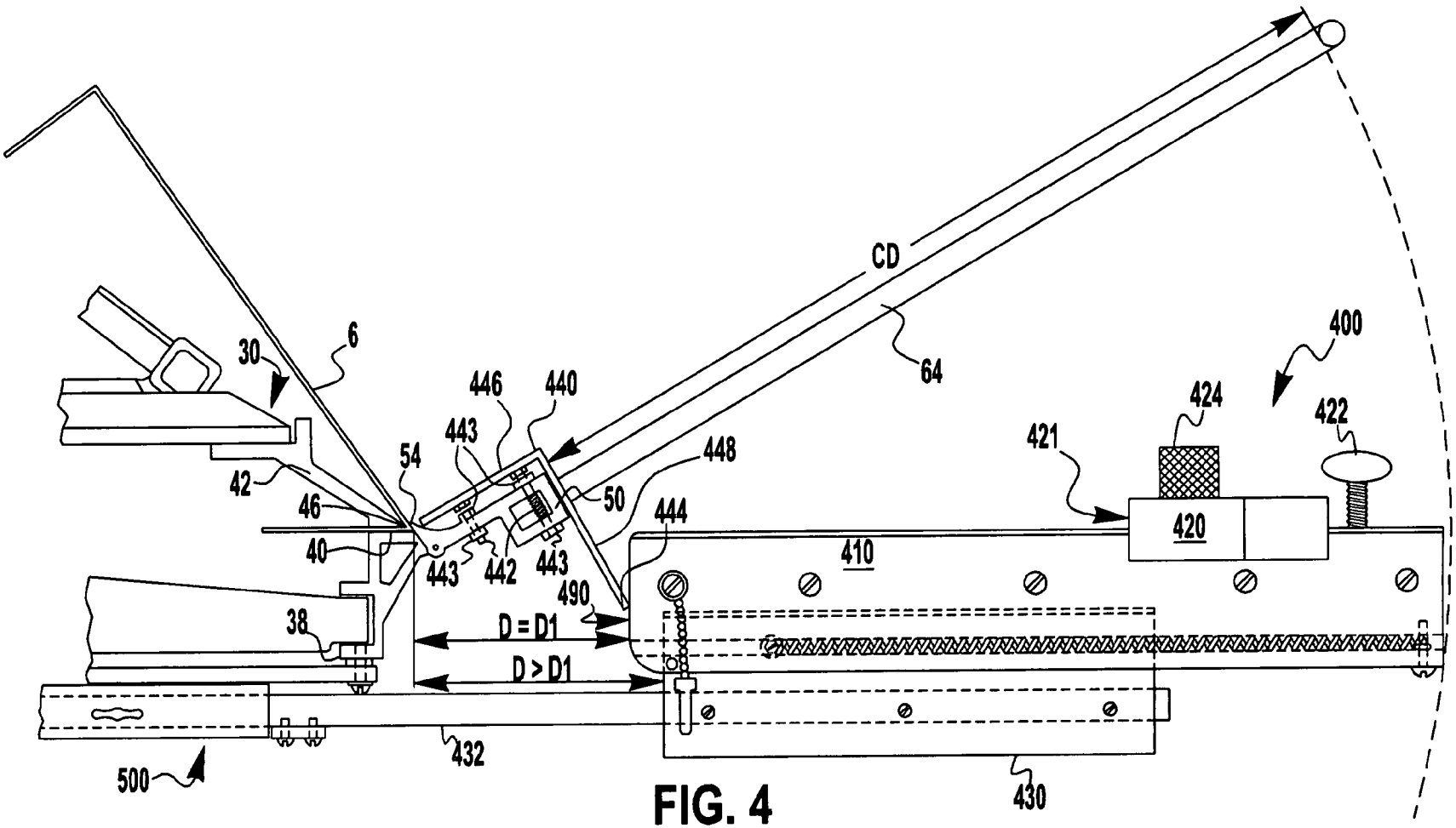
Figures 5A, 5D:
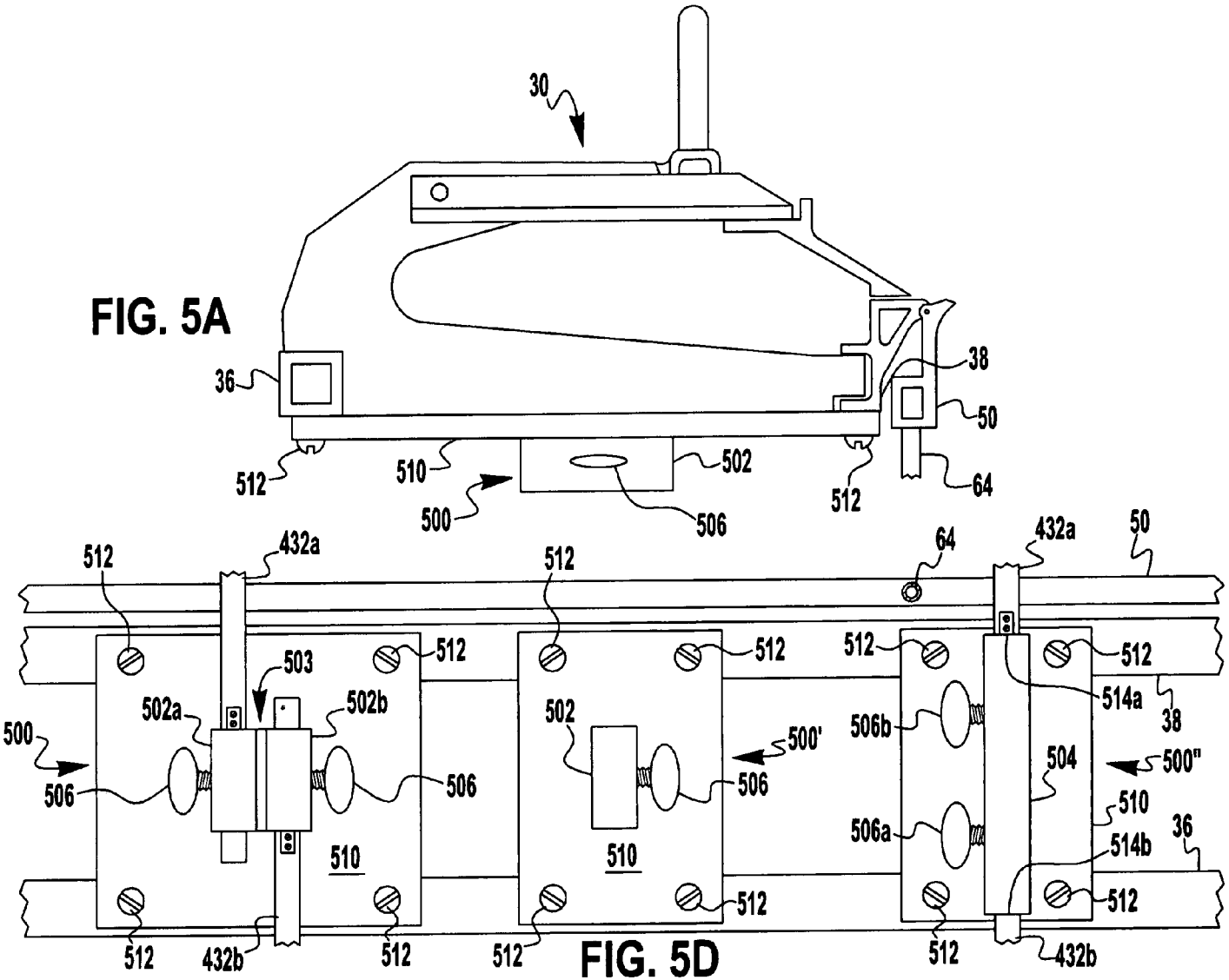
Figure 6:
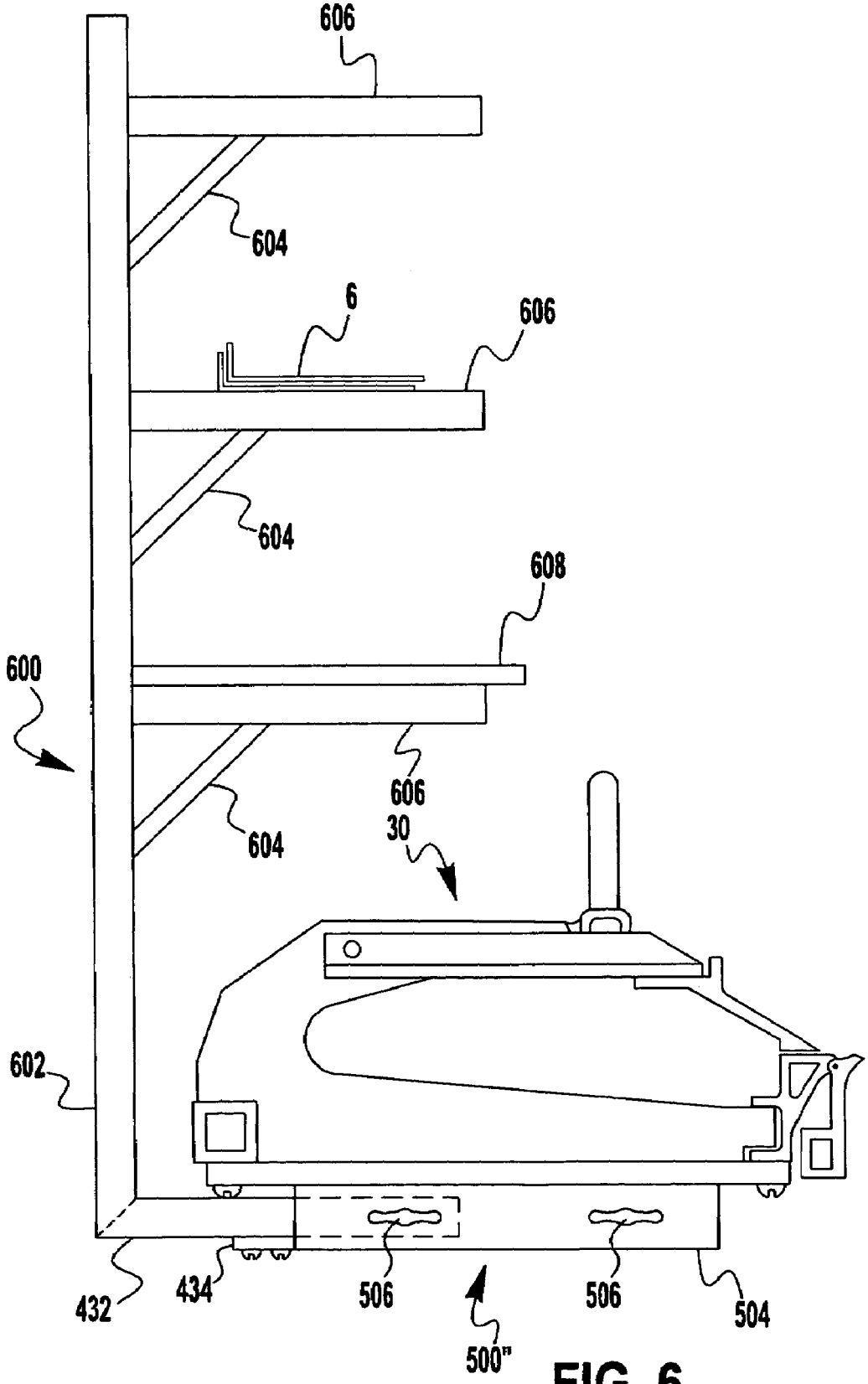
Figure 7A:
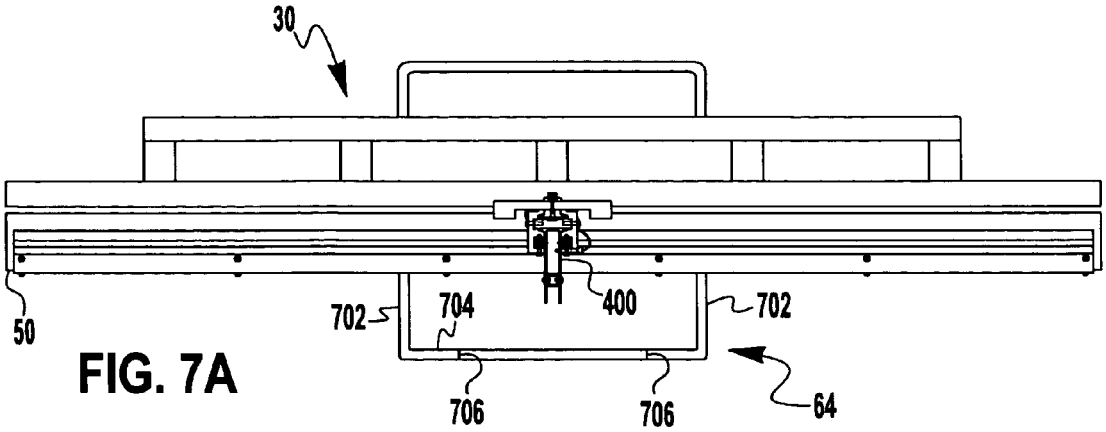
Figure 7B:
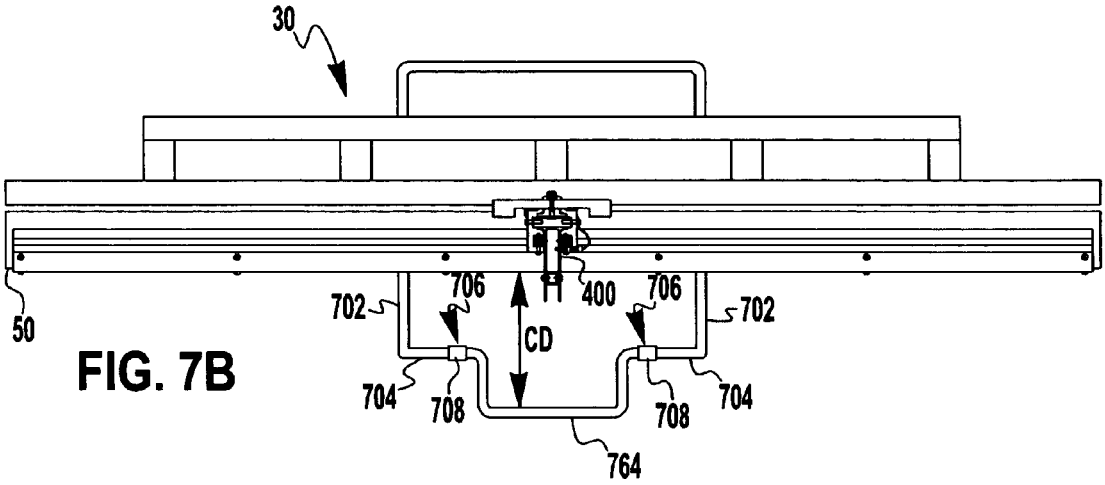
Figure 7C:
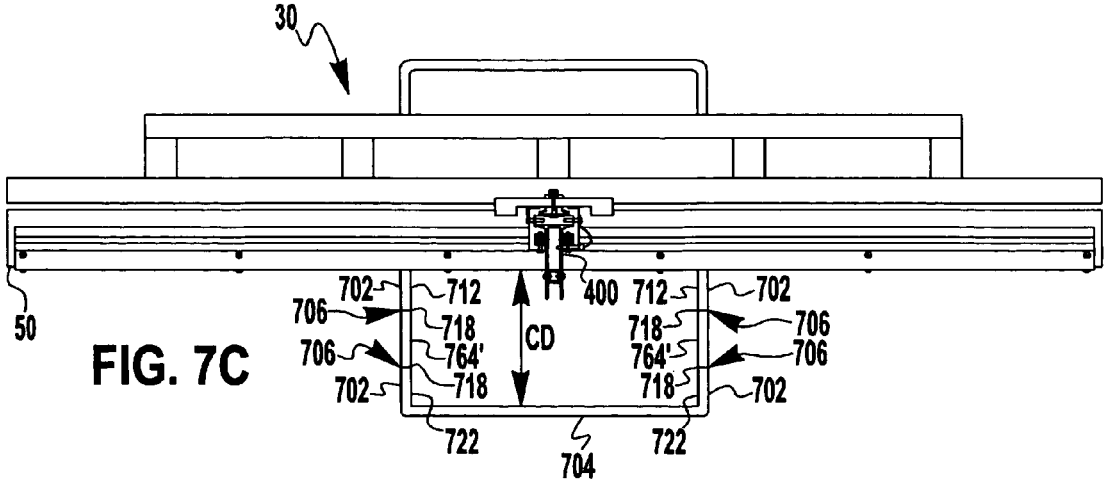

The structure, operation, and advantages of the present preferred embodiment of the invention will become further apparent upon consideration of the following description taken in conjunction with the accompanying drawings, wherein:

FIG. 1 is a perspective view of a sheet bending brake with a simple front mounted front gauge, an under-mounted support and an under-mounted front gauge, according to the invention;

FIG. 2A is an end view of a sheet bending brake with a front mounted front gauge, according to the invention;

FIG. 2B is an front view of a sheet bending brake with two front mounted front gauges and a front mounted support, according to the invention;

FIG. 2C is a magnified front view of a cut-out portion of FIG. 2B showing one of the front mounted front gauges mounted on the brake, according to the invention;

FIG. 2D is a magnified front view of a cut-out portion of FIG. 2C showing a scale in a scale groove of one of the front mounted front gauges, according to the invention;

FIG. 2E is a top view of portions of a front mounted front gauge on a brake, showing several exemplary scales, according to the invention;

FIG. 2F is a magnified front view of portions of a front mounted front gauge, showing an adjustable angle stop, according to the invention;

FIG. 3A is an end view of a sheet bending brake with an under-mounted front gauge, according to the invention;

FIG. 3B is a view of the inside end of the under-mounted front gauge of FIG. 3A, according to the invention;

FIG. 3C is a top view of a portion of the under-mounted front gauge of FIG. 3A, showing several exemplary scales, and an adjustable angle stop, according to the invention;

FIG. 4 is the end view of FIG. 3A, showing dynamic offsetting of the under-mounted front gauge as the brake is used to bend a workpiece, according to the invention;

FIG. 5A is an end view of a sheet bending brake showing a universal mount affixed underneath, according to the invention;

FIG. 5B is a bottom view, looking up at a universal mount coupling having a support bar within it, according to the invention;

FIG. 5C is a magnified end view of a portion of the universal mount of FIG. 3A, according to the invention;

FIG. 5D is a bottom view of a sheet bending brake, looking up at three embodiments of universal mounts, according to the invention;

FIG. 5E is a front view of a double universal mount, according to the invention;

FIG. 6 is an end view of a sheet bending brake with a universal mount and a workpiece rack, according to the invention;

FIG. 7A is a front view of a brake with a U-shaped handle and showing an under-mounted front gauge within the span of the handle, according to the invention;

FIG. 7B is the view of FIG. 7A, showing an accessory handle extension, according to the invention; and FIG. 7C is the view of FIG. 7A, showing an alternative embodiment of an accessory handle extension, according to the invention.

DETAILED DESCRIPTION OF THE INVENTION

FIGS. 1, 2A, and 2B illustrate a portable sheet bending brake 30 having a plurality of longitudinally spaced C-shaped frame members 34 interconnected along a lower rear edge by a rear rail 36 and along a lower front edge by a front rail or elongated bottom member 38. A flat upper surface of the bottom member 38 forms a clamping surface 40, against which a workpiece 6 (see FIG. 2A) in the form of sheet material (e.g., metal or plastic) is clamped for bending and/or cutting. A second elongated member 42 (top member or anvil member) is mounted on longitudinally spaced arms 44, which are pivotally mounted on the C-shaped frame members 34. The forward edge of the top member 42 forms an angulated anvil edge 46 over which sheet material 6 may be bent. Top member 42 is mounted by the arms 44 for clamping movement toward and away from the clamping surface 40 under control of a clamping handle 48, which is coupled to the arms 44 by a plurality of extensible links (not shown). As used in this description the term "sheet material" includes precut blank stock and material provided in rolls or coils. The workpiece 6 is at least a portion of the sheet material that may be in various stages of forming and/or cutting while on or in the brake 30.

A third elongated member, bending member 50, is pivotally mounted to the fixed bottom member 38 by a hinge 52. One or more handle(s) 64, 64' are coupled to the bending member 50 for pivoting the same upwardly with respect to the clamping surface 40, and thereby bending the workpiece 6 that is clamped between first and second members 38, 42 over the anvil edge 46 of the top member 42. The bending member handle(s) may be a single handle 64 in the shape of a broad U (FIG. 1), or it may be one or more, typically a pair, of straight rod-like handles 64' (FIG. 2B). The handle(s) 64, 64' may be removable, e.g., using a pin (not shown). The anvil member 42 also includes a suitable track 32 for receiving and guiding a hand-held width cutter (conventional, not shown). A workpiece 6 to be cut or bent is positioned between bottom and top members 38, 42, and the top member 42 is pivoted downwardly by operation of the clamping handle 48 so as to clamp the sheet material workpiece 6 in the brake 30. Referring to FIGS. 3A and 4, to perform a bend, the bending member 50 is then pivoted upwardly employing handle(s) 64, 64' so that the workpiece 6 is bent over the anvil edge 46 to a desired angle. Alternatively, to cut the sheet material workpiece parallel to the anvil edge 46, a width cutter (not shown) can be slidingly engaged with one or more longitudinal grooves forming the track 32 on the top member 42, and manually propelled along the top member 42 lengthwise of the bending brake 30. To the extent thus far described, the sheet bending brake 30 is of conventional construction and operation. The sheet bending brake 30 of the present disclosure is illustrated and described in a conventional orientation, i.e., with the "top" being in an "upward" or "+Z" direction along a vertical ("top-bottom") Z axis as shown in FIG. 1. Likewise, longitudinal or "left-right" "side" directions are oriented along the Y axis as shown in FIG. 1 (right side is the "+Y" direction); and "in-out" or "back-front" lateral directions are oriented along the X axis as shown in FIG. 1 (out or front is the "+X" direction). The illustrated orientation of the brake 30 should not be considered limiting for the use of the present invention, which could be used in other orientations: for example, mounted on a vertical stand such that the Y axis of the bender 30 is pointing upward (+Y direction), and the X axis of the bender 30 is pointing to the right.

In general, the present invention comprises a scale (distance indicator) in a front gauge (e.g., gauge embodiments 101, 100, 400) that is connected to the sheet bending brake 30 for measuring (indexing, gauging) a width of the workpiece 6 of sheet material with respect to the anvil edge 46, and optionally also for squaring the workpiece 6 with respect to the anvil edge 46, as the workpiece 6 is inserted into the brake 30 between the bottom and top members 38, 42. An important feature of the present invention is mounting that connects the scale to the brake 30 in a way that the scale extends in front of the brake 30 on the bottom member 38 side of the workpiece 6, thereby enabling simple and efficient one-operator use without interfering with brake operation and additionally providing support for the workpiece 6 (at least when the brake 30 is in the conventional orientation as illustrated). Other features and advantages of the present invention will become evident from the following description.

FIG. 1 shows two embodiments of mounting apparatus for connecting the inventive front gauge (e.g., 101, 400) to the brake 30 in the inventive location. A first gauge (gauge 101) according to the invention is a "front mounted" gauge in that it has mounting that attaches the first gauge 101 to the front of the bending member 50 as the bending member 50 hangs down in an at-rest or workpiece loading position. A second gauge (gauge 400) according to the invention is an "under-mounted" front gauge in that it has mounting that attaches the second gauge 400 to the frame (rails 36 and 38) of the brake 30 by way of a support bar 432 that passes underneath the bending member 50 and removably couples with (removably attaches to) a universal mount 500 that is affixed underneath the frame rails 36, 38.

Front Mounted Front Gauge

Still referring to FIG. 1, a simple front mounted gauge 101 is a basic version of a front mounted front gauge according to the invention. A gauge bar 111 extends laterally outward and is attached to the front of the bending member 50 by a right angle bracket 115 held by screws 117, preferably removably (e.g., using wing nuts). Optionally, the bracket 115 is indirectly attached to the bending member 50 by being bolted or clamping onto a handle 64, 64' that extends from the bending member 50. On top of the gauge bar 111 are one or more scales 113 (distance or gauging indicators), illustrated as a first scale 113*a* that measures distance outward from the anvil edge 46, and a second scale 113*b* that measures distance inward from a point that is a predetermined distance (e.g., 24") out from the anvil edge 46. Since sheet material for the workpiece 6 is commonly used in a standard 24" width, the second scale 113*b* can be set up to effectively measure how much of a 24" wide workpiece is inserted into the brake 30 past the anvil edge 46. As will be further described hereinbelow, other gauging scales/distance indicators are known or obvious and can be applied as a form of scale 113. The gauge 101 is optionally improved by a sliding stop 121 that allows predetermined width measurements to be locked-in such that one or more workpieces 6 can be sequentially bent or cut to the same predetermined width by inserting each workpiece 6 into the brake 30 and pushing an outside edge of the workpiece 6 on the gauge bar 111 and outward against the stop 121. The exemplary stop 121 is slidably held on the gauge bar 111 by a stop screw 123 including a bolt and wing nut wherein the stop screw 123 passes through and slides along in a slot 119 through the gauge bar 111. The stop 121 is maintained at a fixed angle relative to the anvil edge 46, preferably fixed in parallel alignment with the anvil edge 46 in order to "square" any workpiece 6 that is stopped against the stop 121. For a stop 121 made of sheet metal, this can be easily accomplished with D-shaped punch-out tabs that are bent down and positioned as edge guides 127 for sliding along side edges of the gauge bar 111.

The simple front mounted gauge 101 meets the primary objectives of the present invention, but may be somewhat limited in other desirable features, such as adjustability, removability, and robustness. With reference to FIGS. 2A–2F, a preferred embodiment of a front mounted front gauge, the front mounted gauge 100, will now be described.

Referring first to FIGS. 2A (side view), 2B (front view), and 2C (detailed partial front view), a gauge bar 110 extends laterally outward and is attached to the front of the bending member 50 by a right angle bracket 130, optionally reinforced by a brace 132 (only shown in FIG. 2A). The gauge bar 110 has a rhomboidal (dovetail) cross section, thereby providing flanged sides 108, and is affixed to the bracket 130, for example by screws or rivets 138.

In order to provide for easy longitudinal repositioning and removability (removable attachment) of the front mounted gauge 100, the bracket 130 is adjustably attached to a slider 152 by screws 136 that pass through vertical adjustment slots 137 cut into the bracket 130, and the slider 152 is slidably retained by a track 150 that extends longitudinally, preferably along most of the longitudinal extent of the bending member 50. The track 150 has open ends so that the slider 152 can be slid into/out-of retainment by the track 150. The track 150 and the slider 152 have corresponding (mating) cross-sectional profiles suitable for sidably retaining the slider 152 by the track 150. For example, the slider 152 is T-shaped and the track 150 has a corresponding channel with a square-C-shaped cross-section. In an alternative example (not shown but obvious), the track 150 has a T-shaped ridge and the slider 152 has a mating C-shaped channel. Although the track 150 could be directly affixed to, or built-in, or even formed (e.g., extruded) as a part of, the bending member 50, an aftermarket version of the present invention may require one or more of an adapter 140 that is affixed to the bending member 50 by a suitable number of screws 142, 144 (e.g., self drill-tapping screws) to provide a level and vertical front surface upon which to affix the track 150 (e.g., by adhesive, not shown).

Further robustness of support is optionally provided by one or more sliding supports 134 (e.g., nylon screws with a staked thread, or a locknut) such that the sliding supports 134 are adjusted to a point where they make sliding contact with the front of the bending member 50 or any related surfaces, e.g., the adapter 140 and/or the track 150. Of course screws are only an exemplary embodiment of a sliding support 134. Many variations should be apparent given the teaching herein, all of which are intended to be within the scope of the present invention. For example, the sliding support 134 could be plastic bumpers riveted on the bracket 130; for example the bottom of the bracket 130 could be curled under; for example the track 150 could be extended downward; for example the track 150 could have a second parallel channel or ridge for a second slider being the sliding support 134; etc.

On some brakes 30 it may be necessary to provide at least one verticality stop 160 (see FIG. 2A) that employs, for example, a set screw and angle bracket attached to the front rail 38 such that the set screw is adjusted to contact the bending member 50 in a way that prevents it from swinging back (under the cantilevered weight of the gauge 100) past a vertical orientation for the front of the bending member 50 or adapter 140.

Thus, front mounting components of the gauge 100 include at least the track 150 and the slider 152, and may also include the adapter 140 and/or the verticality stop 160.

Referring now primarily to FIGS. 2C, 2D, and 2E, a variety of gauging indicators are illustrated. At a top surface 118 (supporting surface) of the gauge bar 110 are one or more scales 112 (distance or gauging indicators), illustrated as a first scale 112*a* that measures distance outward from the anvil edge 46, a second scale 112*b* that measures distance inward from a point that is a predetermined distance (e.g., 24") out from the anvil edge 46, and a third scale 112*c* that is a set of hand labeled gauging indicator marks erasably pencil-marked by an operator of the brake 30. In addition to the scales 112, plus scales 414 that will be further described hereinbelow with reference to FIGS. 3B–3C, other gauging indicators may be known or obvious and can also be applied as a form of scale 112. In order to facilitate erasable marking on the top surface 118 of the gauge bar 110, at least one writable surface is provided, e.g., by roughening the surface (e.g., brushed aluminum). In the preferred embodiment of the front mounted gauge 100, the first and second scales 112*a*, 112*b* are removably held in place by corresponding first and second scale grooves 114*a*, 114*b*, respectively (collectively known as scale grooves 114), wherein each of the scale grooves 114 has lips 172 to form a shallow square-C-shaped groove. The scale grooves 114 are dimensioned to hold a commercially available flexible strip scale (e.g., a metal or semi-rigid plastic tape measure "tape"). The scales 112 are interchangeable if different scale markings are desired (e.g., English vs. metric), and are replaceable if damaged. Furthermore, in order to adapt the scales 112 for an aftermarket installation of the gauge 100, the scales 112 can be trimmed in length as needed and slid up against the outer bending edge 54 of the bending member 50 for measuring as close as possible to the bending anvil. Once suitably adapted, the scales 112 are removably held in place by, for example, rubber cement or a screw 174.

The front mounted gauge 100 is preferably improved by a sliding stop 120 that allows predetermined width measurements to be locked-in such that one or more workpieces 6 can be sequentially bent or cut to the same predetermined width by inserting each workpiece 6 into the brake 30 and pushing an outside edge of the workpiece 6 on the gauge bar 110 and outward against a stop face 124 of the stop 120. The stop 120 has a mortised channel 128 cut into its underside such that the channel 128 slidably engages with the dovetailed flanges 108 of the gauge bar 110, thereby allowing the stop 120 to slide in and out while being held on the gauge bar 110 by the flanges 108. The channel 128 is cut at a predetermined angle with respect to the long, in-out, direction of the gauge bar 110, preferably a right angle such that the stop face 124 is fixed in parallel alignment with the anvil edge 46 in order to "square" any workpiece 6 that is stopped against the stop 120. The stop 120 is held at any desired gauge width by a stop screw 122 (e.g., a thumb screw) threaded through the stop 120 and extending below to press against the gauge bar 110, preferably within a stop screw groove 116 so that screw impressions in the top surface of the gauge bar 110 do not interfere with sliding the stop 120. It should be apparent that other flange and slidably engaging channel shapes could be substituted as functional equivalents for the dovetailed flanges 108 and correspondingly-mortised channel 128. For example, the gauge bar 110 could have a rectangular cross-section with narrow sides forming squared-off flanges 108 that extend sideways beyond the supporting bracket 130, and the stop 120 could have a channel 128 formed by L-shaped clips that hook down and under the flanges 108.

An alternate embodiment of the stop 120, an adjustable angle stop 180, is partially illustrated in FIG. 2F. Other features are comparable to features of a comparable adjustable angle stop 420 as illustrated in FIG. 3B and particularly in FIG. 3C. The adjustable angle stop 180 (compare stop 420) is rotatably attached to a channel-like clip 181 (compare slider 425) that in turn slidably engages with the flanges 108 (compare lips 408) of the gauge bar 110 (compare base 410). The rotatable attachment is, for example, a wing nut-and-bolt attachment 184 wherein the bolt's head can protrude into the stop screw groove 116. In addition to providing a rotating pivot (compare pivot 426), the attachment 184 also provides a rotational angle holding function wherein the wing nut 184 (compare angle lock bolt 424) is hand-loosened, the adjustable angle stop 180 is rotated to a desired angle, and the wing nut 184 is tightened. The stop screw 122 (not shown in FIG. 2F, compare stop screw 422) is preferably threaded through the clip 181 to protrude into the stop screw groove 116 at a spot where the clip 181 extends outward beyond the stop 180. The adjustable angle stop 180 has downward-extending flanges 187 (compare flanges 427) for stopping workpiece 6 edges wherein the sheet material is thin and flexible enough to bend down over the gauge bar 110 and possibly slip underneath a stop that didn't have such flanges 187. Another advantage of the flanges 187 becomes apparent when a workpiece 6 has a downward-bent edge that must be stopped against the stop 180. In this situation, the downward-bent edge of the workpiece 6 can be positioned longitudinally beside the gauge bar 110 and laterally stopped against the stop face 124 of the flange 187. It may be noted that the stop 120 has built-in flanges since it extends downward to contain the channel 128. In essence, the flanges 187 are like channel 128 sides that have been cut out sideways enough to allow the channel 128 to rotate with respect to the gauge bar 110. Preferably an arcuate portion with an angle scale 188 (compare 428) is provided along with a scale pointer (comparable to a pointer 429) that is suitably marked on the clip 181 (compare slider 425).

It can be seen that the front mounted gauge 100 can be removably mounted on the front of the bending member 50 by sliding the slider 152 into either end of the track 150, thereby slidingly engaging the gauge's slider 152 with the gauge's track 150. Furthermore, one or more of the front mounted gauges 100*a*, 100*b* (collectively called front mounted gauges 100) can be slid to any desired longitudinal position. For example, as shown in FIG. 2B, a first front mounted gauge 100*a* is positioned approximately at one end of the brake 30, and a second front mounted gauge 100*b* is positioned in the approximate center. Using two gauges 100 in this way allows for two gauging points for accurately squaring or angling a workpiece 6 that is at least as long as the distance between the two gauges 100. Alternatively, the stops 120 can be used for squaring and/or angling, and the stops 120 on the first and second front mounted gauges 100*a*, 100*b* can be set to first and second different predetermined widths so that the first gauge 100*a* is used to gauge a first bend or cut, and the second gauge 100*b* is used to gauge a second bend or cut. Of course this technique requires the use of workpiece 6 sheet material that is sufficiently flexible to bend over the top of the stop 120 on the one of the gauges 100*a*, 100*b* that is set to a narrower width. Alternatively, at least the narrower-set front mounted gauge 100 could be used with the stop 120 removed, and the scales (e.g., scales 112) of the two gauges 100 could be used to square or angle the workpiece 6 as desired.

FIG. 2B illustrates an accessory front mounted support 301, comprising a blank gauge bar 310 (no predetermined scales or markings, and no stop 120), that is mounted on the bending member 50 as taught for the front mounted gauge 100, e.g., using the bracket 130 that can be directly attached to the bending member 50, or indirectly attached using the slider 152 in the track 150 that is attached to the bending member 50. Of course, if desired, the user may choose to hand make gauge markings on the top supporting surface 308 of the front mounted support 301, for which purpose the top surface 308 is optionally made writable.

If cutting of the workpiece 6 is to be done, then the front gauge 100 and/or the front mounted support 301 may need to be slid out of the way of the width cutter (conventional, not shown). Alternatively, the front mounted front gauges (e.g., 100, 101) and supports (e.g., 301) can be attached to their mounting brackets (e.g., 130, 115) such that their scales (e.g., 112, 113) and, if necessary, their gauge bars (e.g., 110, 111, 310) are offset outward and/or downward from the anvil edge 46 a distance sufficient to avoid interfering with the width cutter.

Initial Setup for the Front Mounted Front Gauge or Front Mounted Support

Certain components of the gauge 100 and support 301 (i.e., the track 150—optionally with the adapter(s) 140, the scales 112, optionally the gauge bars 110, 310, and possibly the verticality stop 160) require an initial setup (installation) before the gauge 100 or support 301 can be used. The initial setup can be accomplished either by a manufacturer of the brake 30 (for an OEM, or built-in version of the gauge 400), or by a user of the brake 30 (for an aftermarket installation). In a step of the initial setup, one or more adapters 140 are installed if used, i.e., affixed as described hereinabove along the length of the bending member 50. In another step of the initial setup, the track 150 is affixed to the bending member 50 (optionally by means of one or more adapters 140) such that the gauges 100 and/or supports 301 will be positioned at the desired height when slidingly engaged with the track 150 (e.g., preferably such that the top surface 118, 308 is level with the upper clamping surface 40 of the bottom member 38). If needed, one or more verticality stops 160 are affixed to the brake 30 and adjusted as described hereinabove. In adjusting steps, each gauge 100 and support 301 may need to be leveled by adjustment of the support screw 134, and/or may need to have its height adjusted using the screws 136 in the vertical adjustment slots 137 cut into the bracket 130. The scales 112 are preferably trimmed as needed, slid inward up against the outer bending edge 54, and secured in position as described hereinabove. Optionally the gauges 100 and supports 301 are attached to their mounting brackets 130 such that the scales 112 and, if necessary, the gauge bars 110, 310 are offset outward and/or downward from the anvil edge 46 a distance sufficient to avoid interfering with a width cutter.

Under-Mounted Front Gauge

Referring to FIG. 1, it can be seen that if a front gauge is to be positioned in front of the bending member 50, then it must be mounted in a way that avoids interference with the swinging motion of the bending member 50 as it pivots upward and outward during bending operation of the brake 30. The inventive front-mounted front gauge (e.g., gauges 100, 101 disclosed hereinabove) avoids interference by being attached to the bending member 50 such that it swings with the bending member 50. According to the invention, another solution to the interference problem is to under-mount the front gauge (provide mounting that attaches the gauge underneath the brake 30), and then to either statically or dynamically offset the front gauge far enough forward to avoid the interference.

Referring to FIGS. 1, 3A and 4, an offset distance D is illustrated. The minimum required magnitude D1 for the offset distance D is empirically determined by swinging the bending member 50, along with any attachments on the bending member (e.g., a cam plate 440), upward during a bend as shown in FIGS. 3A and 4. The magnitude of the offset distance D must be sufficient to avoid interference between the gauge (e.g., a fixedly mounted base 430 of the gauge 400) and the swinging parts of the brake 30 (e.g., a cam point 444 of the cam plate 440 that is attached to the bending member 50).

Under-mounting with a static offset according to the invention is shown in FIG. 1 by an accessory under-mounted support 300, and an under-mounted front gauge 400 when it is in a pinned-back state as shown. The under-mounted support 300 is mounted in a way that statically provides a desired offset distance D between the brake 30 and the top surface 318 of the under-mounted support 300. Preferably, the static offset distance D is of a magnitude sufficient to avoid interference with operation of the brake 30 (e.g., bending, cutting). In other words, the under-mounted support 300 does not have to be moved from its fixed mounting location in order to provide the desired offset distance D. The offset distance D of the under-mounted support 300 is static because it doesn't change during operation of the brake 30. The under-mounted support 300 comprises a bracket portion 330 (preferably integral with the top surface 318) that extends downward from the top surface 318. Under-mounting is provided by affixing (e.g., with self drill-tapping screws 331) the bracket 330 to a support bar 432 that passes underneath the bending member 50 and is attached underneath the frame rails 36, 38, preferably by removably coupling the support bar 432 with the universal mount 500.

FIGS. 5A–5E show various views of the universal mount 500, 500', 500", which is a preferred embodiment of an under-mounting apparatus that enables removable attachment underneath the frame rails 36, 38 of the brake 30. One or more square tube couplings 502, 504 are affixed (e.g., by welds 508) to a mounting plate 510 that is affixed underneath the brake by screws 512 (e.g., self drill-tapping screws), in a position that may be determined by the purchaser, preferably orienting the coupling(s) 502, 504 to be substantially perpendicular to the longitudinal dimension Y of the brake 30. Multiple couplings 502, 504 on one or more mounting plates 510 can be affixed as desired, thereby enabling the removable attachment of one or more gauges 400, supports 300, and accessories (to be described hereinbelow) in potentially multiple locations spaced along the length of the brake 30. The single universal mount 500' has a single coupling 502 affixed on the mounting plate 510. The double universal mount 500 has a double coupling 503 comprising a pair of single couplings 502 that are attached back to back and affixed on the mounting plate 510 (e.g., by welds 508, 509). The long universal mount 500" has a long coupling 504. Each coupling 502, 504 is designed to receive an end of a square support bar 432 (e.g., square aluminum tubing) inserted into the coupling 502, 504 and then removably held in place by a manually tightenable set screw 506 (e.g., a thumb screw). The long coupling 504 can be used to hold two support bars 432, wherein a first support bar 432*a* (e.g., for a gauge 400) is inserted into a first end 514*a* of the long coupling 504 and is removably held by a first set screw 506*a*; and a second support bar 432*b* (e.g., for an accessory workpiece rack described hereinbelow) is inserted into a second end 514*b* of the long coupling 504 and is removably held by a second set screw 506*b*. The double coupling 503 can similarly hold two support bars 432 simultaneously: a first support bar 432*a* in a first coupling 502*a* of the double coupling 503, and a second support bar 432*b* in a second coupling 502*b* of the double coupling 503. FIGS. 5B and 5C show an insertion stop 434 that is affixed (e.g., by screws 435) to the support bar 432 in order to establish a repeatable insertion depth for the support bar 432 into the coupling 502, 504, thereby establishing a repeatable offset distance D for devices attached to the support bar 432, e.g., the under-mounted support 300, or the base 430 of the under-mounted front gauge 400.

Referring to FIGS. 1, 3A, 3B, 3C, and 4, the "second" gauge of FIG. 1 is an under-mounted front gauge 400 according to the invention. A significant difference between the under-mounted front gauge 400 and the front mounted front gauges 100, 101 is that the under-mounted front gauge 400 must be designed to avoid interfering with the bending motion of the bending member 50.

The under-mounted front gauge 400 comprises a base 430 with a T-bar top 438 and one or more tines 436 for fixedly attaching the base 430 to the support bar 432, e.g., by self drill-tapping screws 431 that allow for aftermarket adjustment of the gauge 400 height and offset distance D by the purchaser. A body 410 of the gauge 400 forms a gauge bar that is shaped to slide in/out on the base 430. One or more tension springs 498 are attached between the base 430 (using screws 419) and the body 410 (using screws 417), thereby spring biasing the body 410 inward (toward the brake 30). Preferably the springs 498 are protectively housed in spring grooves 496. Thus the base 430 functions as a bracket (compare bracket 130) for connecting the gauge bar body 410 to the support bar 432. The illustrated embodiment of the body 410 is a three-piece construction using plastic (high density polyethylene), machined as needed, but could easily be molded or extruded using a variety of materials. A rectangular crossbar 412 connects left and right body sides 411*a*, 411*b* that are mirror images of each other. Screws 413 are used to hold the body 410 together. Preferably warping is prevented by using known machining techniques such as the undercut grooves shown where the body sides 411*a*, 411*b* are machined to receive the crossbar 412.

Referring now primarily to FIGS. 3B and 3C, a variety of gauging indicators are illustrated. At a top surface 418 (supporting surface) of the body 410 are one or more scales 414 (distance or gauging indicators), illustrated as a first scale 414*a* that measures distance outward from the anvil edge 46, a second scale 414*b* that is a set of hand made marks 415 on a template strip 414*b*, and a third scale 414*c* that is a set of hand labeled gauging indicator marks erasably pencil-marked by an operator of the brake 30. In addition to the scales 414, and the scales 112 described hereinabove with reference to FIGS. 2C, 2D, and 2E, other gauging indicators may be known or obvious and can also be applied as a form of scale 414. In order to facilitate erasable marking on the top surface 418, at least one writable surface is provided, e.g., by roughening the top surface 418 (e.g., wire brushed); or, for example, by applying a matt finished adhesive tape. In the preferred embodiment of the under-mounted front gauge 400, the first and second scales 414*a*, 414*b* are removably held in scale recesses 409. For example, the first scale 414*a* could be a commercially available adhesive backed ruler that may be cut to size as needed and then self-adhered in one of the scale recesses 409. For example, a metal scale (e.g., template strip 414*b*) could be bent down over the outside edge of the body 410 and then held in place by adhesive tape 491. Alternatively, one or more of the scale recesses 409 could be fashioned like the scale grooves 114. The scales 414 are interchangeable if different scale markings are desired (e.g., English vs. metric, measuring outward vs. measuring inward, etc.), and are replaceable if damaged. Furthermore, in order to adapt the scales 414 for an aftermarket installation of the gauge 400, the scales 414 can be trimmed in length as needed and slid up against the outer bending edge 54 of the bending member 50 for measuring as close as possible to the bending anvil. Once suitably adapted, the scales 414 are then held in place, preferably removably.

Precision compound bending may be accomplished by means of the template strip scale 414*b* in a front gauge (e.g., 400), wherein the template strip has been formed according to well-known conventional techniques as described, for example, by Spencer et al. in U.S. Pat. No. 5,761,939. A strip of malleable material is selected and bent in one or more places to form a desired contour. The strip may be of scrap sheet aluminum, for example, or may be precut and provided in packages. Prefabricated strips may bear distance indicia to assist in making the desired bends. In any event, after the template strip is formed to the desired contour, it is then reflattened, but the one or more bends leave clearly discernable bend stress lines (e.g., marks 415 as shown in FIG. 3C). According to conventional practice, the flattened template strip is then placed along the longitudinally spaced ends of the sheet aluminum stock to be bent, and the sheet stock is then either marked as with a pencil or cut by snips at positions corresponding to the desired bends. This time-consuming conventional procedure is greatly improved for mass production (making the same contour in multiple successive workpieces 6) by using the conventionally prepared template strip as a template strip scale 414*b* on one of the front gauges 100, 101, 400 according to the present invention.

If an adjustable stop and/or square (e.g., stop 420) is desired, then a T-shaped slider 425 is provided for sliding in/out while being retained in the body 410 by lips 408. The stop 420, attached to the slider 425 (e.g., by screw 426, FIG. 3C), is held at any desired gauge width by a stop screw 422 (e.g., a thumb screw) threaded through the slider 425 and extending below to press against the crossbar 412, that is preferably protected by a metal wear strip 416 recessed into the crossbar 412.

The under-mounted front gauge 400 can be used without a stop and/or square (e.g., stop 420), wherein the one or more scales 414 can be used to determine gauge widths for a workpiece 6. Preferably, the under-mounted front gauge 400 has an adjustable stop 420 that is mounted on the slider 425 at a predetermined angle with respect to the long, in-out, direction of the gauge body 410, preferably a right angle such that a stop face (e.g., 421) is fixed in parallel alignment with the anvil edge 46 in order to "square" any workpiece 6 that is stopped against the stop 420. Most preferably, the under-mounted front gauge 400 has an adjustable angle stop 420 as shown for the preferred embodiment of the gauge 400. The adjustable angle stop 420 is rotatably attached to the slider 425 by a pivot 426 and/or by an angle lock bolt 424. The angle lock bolt 424 is a manually tightenable bolt, e.g., a knurled knob, and passes through an arcuate slot 423 to be screwed into the slider 425. When the angle lock bolt 424 is manually loosened, the adjustable angle stop 420 can be rotated around the pivot 426 to a desired angle, and then the desired angle can be held by tightening the angle lock bolt 424. The adjustable angle stop 420 has downward-extending flanges 427 for stopping workpiece 6 edges wherein the sheet material is thin and flexible enough to bend down over the body 410 and possibly slip underneath a stop that didn't have such flanges 427. Furthermore, the flanges 427 can also be used to stop a bent-downward edge of a workpiece 6. The flanges 427 are cut out sideways enough to allow the stop 420 to rotate with respect to the body 410. Preferably an arcuate portion with an angle scale 428 is provided along with a scale pointer 429 that is suitably marked on the slider 425.

Referring now primarily to FIGS. 1, 3A, and 4, a cam plate 440 is shown. The cam plate 440 is a right angle bracket having a front face 446 that is affixed on the bending member 50 by, for example, recessed-head bolts 442 and lock nuts 443 that are positioned such that the front face 446 is vertical when the bending member 50 is hanging vertically in an at-rest position. The lock nuts 443 can be positioned such that the cam plate 440 stands outward from the bending member 50 as needed to adapt the cam plate 440 to a potentially non-flat surface of the bending member 50. The cam plate 440 must be affixed on the bending member 50 adjacent to each one of one or more universal mounts 500, 500', 500" that have been affixed under the brake 30 at selected locations as described hereinabove. Optionally, multiple cam plates 440 for multiple selected locations can be combined into a single longer cam plate 440 that extends along large portions of the length, even along the entire length, of the bending member 50. The cam plate 440 has a bottom portion 448 (preferably at a right angle to the front face 446) that extends under and behind the bending member 50 to a cam point 444. The bottom portion 448 extends far enough to cause the cam point 444 to remain in contact with a back end 490 of the gauge body 410 when the bending member 50 is pivoted upward to the fill extent of its bending range (as shown in FIG. 4), thereby preventing the spring biased body 410 from moving inward underneath the bending member 50 when it is raised above the body 410. The bottom portion 448 of the cam plate 440 is notched as needed in order to rotate upward without hitting the support bar 432. The bottom portion 448 may also need to be notched to avoid hitting screws 512 of the universal mount 500, or else the screws 512 can be recessed or otherwise positioned to avoid contact with the cam plate 440. The bottom portion 448 extending to the cam point 444 is the most important part of the cam plate 440, therefore the vertical portion could be eliminated and the cam plate 440 could simply be a planar piece of material attached to the underside of the bending member 50 and extending back to the cam point 444 behind the bending member 50.

Also referring to FIG. 3B, a lockout pin 494 is shown. Preferably the lockout pin 494 includes a means for loss prevention, e.g., a bead chain tied to a screw, e.g., screw 413 in the side of the body 410. As shown in FIGS. 1, 3A and 3B, the gauge body 410 can be manually slid outward against its spring bias until an outer hole 492 in the body 410 lines up with an inner hole 493 in the base 430, and then the lockout pin 494 can be inserted through both outer and inner holes 492, 493, thereby holding the gauge 400 in a pinned-back state.

Initial Setup for the Under-Mounted Front Gauge or Under-Mounted Support

Certain components of the gauge 400 and the support 300 (i.e., the universal mount 500, 500', 500", the cam plate 440, the support bar 432, and the insertion stop 434) require an initial setup (installation) before the gauge 400 or support 300 can be used. The initial setup can be accomplished either by a manufacturer of the brake 30 (for an OEM, or built-in version of the gauge 400 or support 300), or by a user of the brake 30 (for an aftermarket installation). It should be noted that because the universal mounts 500, 500', 500" comprise a flexible under-mounting system, the "initial" setup can take place once, or many times wherein the initial setup may be repeated as components are moved to new locations on the brake 30, and/or as extra components are additionally installed on the brake 30. In a step of the initial setup, one or more universal mounts 500, 500', 500" are affixed beneath the brake 30 as described hereinabove to provide couplings 502, 503, 504 at desired (selected) locations along the length of the brake 30. In another step of the initial setup, one or more cam plates 440 are installed (affixed as described hereinabove) in locations corresponding to the desired locations. In another step of the initial setup, for each of one or more gauges 400 to be used on the brake 30: a support bar 432 is affixed to the base 430 and an insertion stop 434 is affixed to the support bar 432 such that the support bar 432 will repeatably position the gauge 400 at the desired height (e.g., such that the top surface 418 is level with the upper clamping surface 40 of the bottom member 38), and the base 430 at an offset distance D greater than or equal to the minimum required offset distance magnitude of D1, whenever the support bar 432 of the gauge 400 is inserted into one of the couplings 502, 503, 504 of the universal mount(s) 500, 500', 500". Similarly, for each of one or more supports 300 to be used on the brake 30: a support bar 432 is affixed to the bracket portion 330 and an insertion stop 434 is affixed to the support bar 432 such that the support bar 432 will repeatably position the support 300 at the desired height (e.g., such that the top surface 318 is level with the upper clamping surface 40 of the bottom member 38), and the top surface 318 at an offset distance D greater than or equal to the minimum required offset distance magnitude of D1, whenever the support bar 432 of the support 300 is inserted into one of the couplings 502, 503, 504 of the universal mount(s) 500, 500', 500".

Operational Example for Under-Mounted Front Gauge and Support

Referring now primarily to FIGS. 1, 3A and 4, an example will be described of the operation (use) of a brake 30 that has one or more under-mounted front gauges 400, and optionally has one or more under-mounted supports 300, all according to the invention. In this example, it is assumed that the initial setup of the gauge(s) 400 and support(s) 300 has been previously completed.

In order to be used, the brake 30 is typically transported to a worksite in, for example, a van. In order to facilitate loading and unloading from the van, and/or to prevent damage, the one or more gauges 400 and supports 300 are transported in an uncoupled state wherein the support bar 432 is separate from (not coupled with) any of the one or more universal mounts 500, 500', 500" on the brake 30. At the worksite, the brake 30 is unloaded from the van and positioned for use by, for example, being placed on saw-horses. For each of the one or more gauges 400, the uncoupled portion of the gauge 400 is also unloaded; a one of the universal mount couplings 502, 503, 504 is selected based on its location at a desired gauging location along the length of the brake 30; and the gauge 400 is under-mounted by inserting its support bar 432 into the selected coupling 502, 503, 504 until the insertion stop 434 abuts against the selected coupling 502, 503, 504 after which the coupling set screw 506 is hand tightened to hold the gauge 400 firmly in place. Preferably an under-mounted support 300, or more preferably a second under-mounted front gauge 400, is similarly under-mounted in a second desired location along the length of the brake 30. Optionally, additional under-mounted supports 300 and/or under-mounted front gauges 400 are similarly under-mounted in additional desired locations along the length of the brake 30. The first, preferable second, and optional additional desired locations are selected for providing adequate support, gauging, (and optionally squaring) of workpieces 6 that are to be manipulated (e.g., bent, cut, crimped) in the brake 30.

In this example, a 12 foot long, 6" (inch) wide strip of aluminum sheet stock is to receive two right angle bends, thereby creating a 1"×4"×1" square-U-shaped trim strip. Assuming that the sheet stock is supplied as a 24" wide roll (not illustrated), the first step is to create a 12 foot long, 6" wide workpiece 6. A 12 foot length of aluminum sheet is pulled off the roll and extended down the length of the bender 30, supported by the upper clamping surface 40, by one under-mounted front gauge 400 that is located 3 feet in from the right end of the brake 30, and by one under-mounted support 300 that is located 6 feet to the left of the gauge 400. The workpiece 6 is cut off of the roll at a 12 foot length by conventional means. Assuming that a width-cutting attachment (conventional, not illustrated) for the brake 30 makes a lengthwise cut at an offset distance D of 1" (i.e., one inch in front of the anvil edge 46), then the gauge stop 420 is positioned at 24−6+1=19 inches out from the anvil edge 46 (e.g., 19 on the scale 414*a*) in order to cut a 6" wide strip off the 24" wide piece of sheet material. Alternatively, if an in-counting scale (e.g., scale 112*b*) is present, then the stop 420 could be positioned at 5, to indicate that 5" of the 24" width are inside the brake 30 (inward from the anvil edge 46). The stop 420 in this example is an adjustable angle stop, so, in order to square the worksheet 6, the stop 420 is also set to 0° with the angle lock screw 424 tightened to hold the angle setting. Once the stop 420 has been positioned and held in position by tightening the stop screw 422, the outermost edge of the workpiece 6 is pressed against the stop face 421 and the clamping handle 48 is operated to clamp the workpiece 6 in the brake 30. The gauge 400 is then pulled outward and the lockout pin 494 is used to hold the gauge 400 in a pinned-back state so as to allow the width-cutter to cut a 6" wide strip down the length of the brake 30. The support 300 doesn't need to be moved because it is initially setup with a suitable static offset as described hereinabove. After width cutting the brake 30 is unclamped, the 6" wide strip is removed and set aside, and the remaining 18" wide strip is placed between the first and second (clamping) members 38, 42. The gauge 400 is unpinned (lockout pin 494 removed) and the spring 498 causes the gauge 400 to again be biased against the brake 30. The stop 420 is moved in 6" in order to repeat the above process for cutting off another 6" wide strip. A final repeat of the process with the stop 420 moved in another 6" results in four 6" wide by 12 foot long aluminum strips. It should be obvious that this result could also be achieved with only two settings of the gauge 400 by first cutting the 24" wide sheet in half (with the stop 420 at the 13" mark on an outward-counting scale), and then by setting the stop 420 at the 7" mark on an outward-counting scale and using it to make two cuts, one on each half-sheet. Another way of achieving efficiency in a mass production situation (where more than four 6" by 12 foot strips are needed), would be to make the first cut at a 12" wide gauge setting on multiple 12 foot lengths of 24" wide sheet stock, then to change the gauge 400 to the 6" wide gauge setting for making the second cut on all of the 12 foot by 12" strips that resulted from the first cuts.

Next the width cutter is removed from the brake 30, and the gauge 400 (not in a pinned-back state) is set to make a first 1" wide bend in the 6" wide workpieces 6, i.e., the stop 420 is set at 5" out from the anvil edge 46 and locked in place by tightening the stop screw 422. For each of the workpieces 6, the workpiece 6 is placed between the clamping members 38, 42, the outermost edge of the workpiece 6 is pressed against the stop face 421, and the clamping handle 48 is operated to clamp the workpiece 6 in the brake 30. The stop 420 is still set at a 0° angle, so that the workpiece 6 is squared with the brake 30. The bending handle(s) 64, 64' are used to rotate the bending member 50 upward until the workpiece 6 is bent to a 90° angle, thereby forming a first bend in the workpiece 6. By comparing FIGS. 3A and 4, it can be seen that as the bending member 50 rotates upward, propelled by the operator's action on the bending handle(s) 64, 64', the cam plate 440 will cause the body 410 of the gauge 400 to be moved outward, thereby dynamically offsetting the body 410 by an offset distance D that is always sufficient to allow the bending member 50 to rotate upward as needed to make a bend. As noted above, for bends greater than 90° (as shown in FIG. 4), the cam point 444 on the bottom portion 448 of the cam plate 440 continues to dynamically offset the body 410 even when the bending member 50 would have rotated up high enough to lose contact with the body 410. After achieving the desired bend, the bending handle(s) 64, 64' (and bending member 50) are rotated back downward to their at-rest position, and the gauge body 410 automatically returns to its non-offset position against the brake 30, ready for the next bend.

Next, the brake 30 is unclamped, the bent workpiece 6 (having the first bend) is set aside, the next unbent strip (next workpiece 6) is placed between the clamping members 38, 42, and the outermost edge of the workpiece 6 is pressed against the stop face 421 for bending the first bend as described above. This process is repeated on all of the unbent workpieces 6. Note that the gauge 400 setting (positioning of the stop 420) does not need adjustment between first bends on subsequent workpieces 6, therefore efficient mass production can be effected by a single operator.

Once the first bend has been formed on all of the unbent strips, the gauge 400 is adjusted for a second bend: the stop 420 is set at 4" out from the anvil edge 46 and locked in place by tightening the stop screw 422. For each of the first-bent workpieces 6, the unbent edge of the workpiece 6 is placed between the clamping members 38, 42, the edge having the first 90° bend is pressed against the stop face 421 (as in FIG. 3A), and the clamping handle 48 is operated to clamp the workpiece 6 in the brake 30. The stop 420 is still set at a 0° angle, so that the workpiece 6 is squared with the brake 30. The bending handle(s) 64, 64' are used to rotate the bending member 50 upward until the workpiece 6 is bent to a 90° angle, thereby forming the second bend in the workpiece 6. After achieving the desired bend, the bending handle(s) 64, 64' (and bending member 50) are rotated back downward to their at-rest position, and the gauge body 410 automatically returns to its non-offset position against the brake 30, ready for the next bend.

Next, the brake 30 is unclamped, the completed trim piece (the workpiece 6 with both the first and second bends) is set aside, and the next first-bent workpiece 6 is placed between the clamping members 38, 42 and pressed against the stop face 421 for bending the second bend as described above. This process is repeated on all of the first-bent workpieces 6. Note that the gauge 400 setting (positioning of the stop 420) does not need adjustment between second bends on subsequent workpieces 6, therefore efficient mass production can be effected by a single operator.

It should be noted that different combinations of under-mounted front gauges 400 and under-mounted supports 300 may be advantageous in different situations. For example, for short and/or relatively stiff workpieces 6, a single gauge 400 could be employed, preferably positioned near the longitudinal center of the workpiece 6. For example, for long and/or relatively flexible workpieces, a total of 3 or 4 gauges 400 and supports 300 could be employed for better support. For example, the use of two gauges 400, particularly for longer workpieces 6, is advantageous for providing the best accuracy in squaring (or angling) a workpiece 6 relative to the anvil edge 46. The flexibility to employ these and other combinations of under-mounted gauges 400 and under-mounted supports 300 is made possible by the inventive universal mounts 500, 500', 500", that can be affixed at selected multiple locations spaced along the length of the brake 30.

Given the teachings herein, many other methods for advantageously utilizing various combinations of the inventive gauges (e.g., gauge 400) and supports (e.g., support 300) on brakes 30 will become evident to ones of ordinary skill in relevant arts, and all such uses are intended to be within the scope of the present invention.

Operational Example for Front Mounted Front Gauge and Support

Referring now primarily to FIGS. 1 and 2A–2F, an example will be described of the operation (use) of a brake 30 that has one or more front mounted front gauges 100, and optionally has one or more front mounted supports 301, all according to the invention. In this example, it is assumed that the initial setup of the gauge(s) 100 and support(s) 301 has been previously completed. It is further assumed that the gauge(s) 100 are initially setup with one or more scales 112 that extend all the way to the outer bending edge 54, but the support(s) 301 are initially setup with a static offset suitable for allowing longitudinal cutting as described hereinabove.

In order to be used, the brake 30 is typically transported to a worksite in, for example, a van. In order to facilitate loading and unloading from the van, and/or to prevent damage, the one or more gauges 100 and supports 301 are preferably transported in an unmounted state wherein the slider 152 is disengaged from the track 150 that remains on the brake 30. Optionally the one or more gauges 100 and supports 301 are left in a mounted state and the bending member 50 with the mounted gauges 100 and supports 301 is raised up as much as possible, causing the gauges 100 and supports 301 to lie down on the top of the brake 30. At the worksite, the brake 30 is unloaded from the van and positioned for use by, for example, being placed on sawhorses. If transported unmounted, then the unmounted portions of the one or more gauges 100 and supports 301 are also unloaded and each one is then mounted by engaging the slider 152 at either end of the track 150, and by sliding it into position at a desired gauging and/or supporting location along the length of the brake 30. Along with a first front mounted front gauge 100 (e.g., gauge 100*a* in FIG. 2B), preferably a front mounted support 301, or more preferably a second front mounted front gauge 100*b*, is similarly front mounted in a second desired location along the length of the brake 30. Optionally, additional front mounted supports 301 and/or front mounted front gauges 100 are similarly front mounted in additional desired locations along the length of the brake 30. The first, preferable second, and optional additional desired locations are selected for providing adequate support, gauging, (and optionally squaring) of workpieces 6 that are to be manipulated (e.g., bent, cut, crimped) in the brake 30.

In this example, a 12 foot long, 6" (inch) wide strip of aluminum sheet stock is to receive two right angle bends, thereby creating a 1"×4"×1" square-U-shaped trim strip. Assuming that the sheet stock is supplied as a 24" wide roll (not illustrated), the first step is to create a 12 foot long, 6" wide workpiece 6. A 12 foot length of aluminum sheet is pulled off the roll and extended down the length of the bender 30, supported by the upper clamping surface 40, by one front mounted front gauge 100*a* that is located 3 feet in from the right end of the brake 30, and by one front mounted support 301 that is located 6 feet to the left of the gauge 100. The workpiece 6 is cut off of the roll at a 12 foot length by conventional means. Assuming that a width-cutting attachment (conventional, not illustrated) for the brake 30 makes a lengthwise cut at an offset distance D of 1" (i.e., one inch in front of the anvil edge 46), then the gauge stop 120 is positioned at 24−6+1=19 inches out from the anvil edge 46 (e.g., 19 on the scale 112*a*) in order to cut a 6" wide strip off the 24" wide piece of sheet material. Alternatively, if an in-counting scale (e.g., scale 112*b*) is present, then the stop 120 could be positioned at 5, to indicate that 5" of the 24" width are inside the brake 30 (inward from the anvil edge 46). Once the stop 120 has been positioned and held in position by tightening the stop screw 122, the outermost edge of the workpiece 6 is pressed against the stop face 124 and the clamping handle 48 is operated to clamp the workpiece 6 in the brake 30. The gauge 100 is then repositioned longitudinally to avoid interference with the cutter, e.g., the gauge is slid out the end of the track 150. The support 301 doesn't need to be moved because it has a suitable static offset. After width cutting, the brake 30 is unclamped, the 6" wide strip is removed and set aside, and the remaining 18" wide strip is placed between the first and second (clamping) members 38, 42. The gauge 100 is repositioned longitudinally, and the stop 120 is moved in 6" in order to repeat the above process for cutting off another 6" wide strip. A final repeat of the process with the stop 120 moved in another 6" results in four 6" wide by 12 foot long aluminum strips. It should be obvious that this result could also be achieved with only two settings of the gauge 100 by first cutting the 24" wide sheet in half (with the stop 120 at the 13" mark on an outward-counting scale), and then by setting the stop 120 at the 7" mark on an outward-counting scale and using it to make two cuts, one on each half-sheet. Another way of achieving efficiency in a mass production situation (where more than four 6" by 12 foot strips are needed), would be to make the first cut at a 12" wide gauge setting on multiple 12 foot lengths of 24" wide sheet stock, then to change the gauge 100 to the 6" wide gauge setting for making the second cut on all of the 12 foot by 12" strips that resulted from the first cuts.

Next the width cutter is removed from the brake 30, and the gauge 100 is set to make a first 1" wide bend in the 6" wide workpieces 6, i.e., the stop 120 is set at 5" out from the anvil edge 46 (at 5 on an outward counting scale, e.g., scale 112*a*) and locked in place by tightening the stop screw 122. For each of the workpieces 6, the workpiece 6 is placed between the clamping members 38, 42, the outermost edge of the workpiece 6 is pressed against the stop face 124, and the clamping handle 48 is operated to clamp the workpiece 6 in the brake 30. Since the stop 120 is fixed at a 0° angle, the workpiece 6 is squared with the brake 30. The bending handle(s) 64, 64' are used to rotate the bending member 50 upward until the workpiece 6 is bent to a 90° angle, thereby forming a first bend in the workpiece 6. Since the gauge(s) 100 and support(s) 301 are mounted on the bending member 50, they will rotate up with the bending member 50, continuing to provide support for the workpiece 6 throughout the bending process.

Next, the brake 30 is unclamped, the bent workpiece 6 (having the first bend) is set aside, the next unbent strip (next workpiece 6) is placed between the clamping members 38, 42, and the outermost edge of the workpiece 6 is pressed against the stop face 124 for bending the first bend as described above. This process is repeated on all of the unbent workpieces 6. Note that the gauge 100 setting (positioning of the stop 120) does not need adjustment between first bends on subsequent workpieces 6, therefore efficient mass production can be effected by a single operator.

Once the first bend has been formed on all of the unbent strips, the gauge 100 is adjusted for a second bend: the stop 120 is set at 4" out from the anvil edge 46 (e.g., at the 4" mark on an outward counting scale like 112*a*), and locked in place by tightening the stop screw 122. For each of the first-bent workpieces 6, the unbent edge of the workpiece 6 is placed between the clamping members 38, 42, the edge having the first 90° bend is pressed against the stop face 124, and the clamping handle 48 is operated to clamp the workpiece 6 in the brake 30. Since the stop 120 is fixed at a 0° angle, the workpiece 6 is squared with the brake 30. The bending handle(s) 64, 64' are used to rotate the bending member 50 upward until the workpiece 6 is bent to a 90° angle, thereby forming the second bend in the workpiece 6. After achieving the desired bend, the bending handle(s) 64, 64' (and bending member 50 along with mounted gauge(s) 100 and support(s) 301) are rotated back downward to their at-rest position, ready for the next bend.

Next, the brake 30 is unclamped, the completed trim piece (the workpiece 6 with both the first and second bends) is set aside, and the next first-bent workpiece 6 is placed between the clamping members 38, 42 and pressed against the stop face 124 for bending the second bend as described above. This process is repeated on all of the first-bent workpieces 6. Note that the gauge 100 setting (positioning of the stop 120) does not need adjustment between second bends on subsequent workpieces 6, therefore efficient mass production can be effected by a single operator.

It should be noted that different combinations of front mounted front gauges 100 and front mounted supports 301 may be advantageous in different situations. For example, for short and/or relatively stiff workpieces 6, a single gauge 100 could be employed, preferably positioned near the longitudinal center of the workpiece 6. For example, for long and/or relatively flexible workpieces, a total of 3 or 4 gauges 100 and supports 301 could be employed for better support. For example, the use of two gauges 100, particularly for longer workpieces 6, is advantageous for providing the best accuracy in squaring (or angling if using the adjustable angle stop 180) a workpiece 6 relative to the anvil edge 46. The flexibility to employ these and other combinations of front mounted gauges 100 and front mounted supports 301 is made possible by the inventive front mounting components including the track 150 and the slider 152 that allow positioning of one or more gauges 100 and supports 301 for accurate gauging at any longitudinal position along the length of the brake 30.

Workpiece Rack Accessory

FIG. 6 shows a workpiece rack 600 that is an accessory for providing a convenient rack for temporarily shelving one or more workpieces 6 while they are involved in a mass production process such as is described hereinabove. The workpiece rack 600 includes one or more vertical posts 602, each of which is affixed (e.g., welded) to a support bar 432 at the bottom, and to at least one arm 606 above. The support bar 432 and one or more arms 606 all extend forward from the post 602. Each arm 606 has an optional brace 604. An optional shelf 608 can be affixed to one or more of the arms 606 for extending longitudinally above the brake 30, thereby creating a storage shelf (rack) with one or more supporting posts 602. Also optionally, the shelf 608 is not affixed, but simply rests on the arms 606 of two or more rack posts 602. The workpiece rack 600 is removably under-mounted on the brake 30 using any embodiment of the universal mounts 500, 500', 500" described hereinabove. As illustrated in FIG. 6 for example, the support bar 432 for the workpiece rack 600 is inserted from behind the brake 30 into the long coupling 504 of the long universal mount 500". The insertion depth of the support bar is optionally controlled by an optional insertion stop 434 such that the workpiece rack 600 is positioned properly behind the brake 30 and also such that another support bar 432 (e.g., 432*b* in FIG. 5D) can be inserted into the long coupling 504 from the front of the brake 30. If desired, a set screw 506 (e.g., a thumbscrew) can be hand tightened to hold the workpiece rack 600 in place. The insertion depth of the support bar 432 can be adjusted such that the arms 606 and shelves 608 (if present) will extend forward over the brake 30 as much or as little as desired by the user. One or more workpieces 6 can be conveniently placed to rest across two arms 606, or to rest on a shelf 608 of the workpiece rack 600. The workpiece rack 600 is easily removed for convenient handling and transporting of the brake 30.

Accessory Handle Extension

FIGS. 7A–7C illustrate two embodiments of an accessory handle extension 764, 764' for adapting a U-shaped bending handle 64 for use with an under-mounted front gauge 400 or under-mounted support 300 that is positioned within the span of the U-shaped bending handle 64, e.g., in the center of the brake 30. Obviously, the handle extension 764 is not needed when straight rod bending handles 64' are used, but the U-shaped bending handles 64 are generally preferred, especially on longer brakes 30, because they are easier to use, enabling single-handed operation of the brake 30. The U-shaped bending handle 64 has two arms 702 and a crossbar 704. The handle extension 764, 764' is used if needed to extend the arms 702 enough to provide a clearance distance CD (also see FIG. 4) that enables the crossbar 704 to pass upward around the outermost end of the under-mounted front gauge 400 or under-mounted support 300 as the bending member 50 is rotated upward during a bending operation.

A first embodiment of the handle extension 764 is shown in FIG. 7B. Two cuts 706 are made in the crossbar 704, and the handle extension 764 is attached between the cuts 706, using couplings 708. The couplings 708 are, for example, sleeve couplings with screw fasteners.

A second embodiment of the handle extension 764' is shown in FIG. 7C. A cut 706 is made in each arm 702, dividing each arm 702 into an upper portion 712 and a lower portion 722. The handle extension 764' is attached between the upper portion 712 and the lower portion 722 using couplings 718. The couplings 718 are, for example, tight-fitting plugs that are jammed and/or adhered within the tubular arm 702 and extension 764'.

Although the invention has been illustrated and described in detail in the drawings and foregoing description, the same is to be considered as illustrative and not restrictive in character— it being understood that only preferred embodiments have been shown and described, and that all changes and modifications that come within the spirit of the invention are desired to be protected. Undoubtedly, many other "variations" on the "themes" set forth hereinabove will occur to one having ordinary skill in the art to which the present invention most nearly pertains, and such variations are intended to be within the scope of the invention, as disclosed herein.

What is claimed is:

1. A front gauge for a sheet bending brake, wherein the brake comprises a first longitudinally extending member forming a clamping surface, a second longitudinally extending member positioned over the first member and movable toward and away from the first member for clamping a sheet mater workpiece against the clamping surface and having a longitudinal front edge forming a bending anvil, and a third longitudinally extending member pivotally mounted to the first member for bending over the bending anvil a workpiece that is clamped between the first and second members; wherein the brake is operable in any orientation and, regardless of orientation, "over" is defined to mean on the second member's side of the workpiece, "under" is defined to mean on the first member's side of the workpiece, and "front" is defined to mean a lateral outside or outward facing side of the brake, which is also the side from which the workpiece is inserted past the bending anvil into the brake; the front gauge comprising:

a scale for gauging that extends outward from the front of the sheet bending brake; and mounting that connects the scale to the brake such that the scale is positioned under the workpiece.

2. The front gauge according to claim 1, further comprising:

front mounting wherein the mounting comprises a bracket that attaches the scale to the third member.

3. The front gauge according to claim 2, wherein the mounting further comprises removable attachment of the bracket to the third member, the removable attachment comprising:

an open-ended track that extends longitudinally along at least a portion of the longitudinal extent of the third member; and a slider affixed to the bracket and slidably retainable by the track.

4. The front gauge according to claim 3, wherein the mounting further comprises:

a level-surfaced adapter affixed between the track and the third member; and a sliding support between the bracket and a suitable one of the track or the adapter or the third member.

5. The front gauge according to claim 1, further comprising:

under-mounting wherein the mounting comprises a support bar that passes under the first and third members such that a first end of the support bar is attached to the scale, and an opposed second end of the support bar is attached to a frame portion of the brake.

6. The front gauge according to claim 5, wherein the mounting further comprises removable attachment of the support bar to the frame portion, the removable attachment comprising:

at least one square tube coupling that is affixed under the frame portion and extends laterally, the at least one coupling being sized for slidably engaging with the second end of the support bar;

at least one manually tightenable set screw in a threaded hole through the coupling; and a base connecting the first end of the support bar to the scale.

7. The front gauge according to claim 6, wherein the mounting further comprises:

at least one mounting plate for affixing the at least one coupling to front and rear rails of the frame portion of the brake.

8. The front gauge according to claim 6, wherein the mounting further comprises:

a stop plate affixed on the support bar near the second end such that the stop plate abuts against the at least one coupling when the support bar is slidably engaged with the at least one coupling and is positioned at a predetermined position.

9. The front gauge according to claim 6, wherein:

the scale comprises a body that is slidably connected to the base; and a spring is connected between the body and the base so as to bias the body inward against the third member.

10. The front gauge according to claim 9, further comprising:

a cam plate adjustably affixed to the third member and located at least between the body and the third member; and a bottom portion of the cam plate that extends under and rearward of the third member when the third member is in an at-rest position.

11. The front gauge according to claim 9, further comprising:

a lockout pin; and first and second holes for the lockout pin wherein the first hole passes through the body and the second hole passes through the base such that the second hole is aligned with the first hole when the body is slid outward to a predetermined offset distance from the brake.

12. The front gauge according to claim 1, wherein the scale further comprises any combination of one or more gauging indicators including:

ruled markings that indicate distance outward from the bending anvil;

ruled markings that indicate distance inward from a zero point that is a predetermined distance outward from the bending anvil;

an erasable temporary marking surface with hand made marks; and a template strip.

13. The front gauge according to claim 12, wherein the scale further comprises:

a gauge bar with at least one scale groove or scale recess for removably and adjustably retaining a selected one of the gauging indicators.

14. The front gauge according to claim 1, further comprising:

a stop that is slidingly connected to the scale for sliding in and out.

15. The front gauge according to claim 14, further comprising:

a manually tightenable set screw in the stop.

16. The front gauge according to claim 14, wherein the stop further comprises:

a stop face that is normal to the scale, and that extends both over and under the scale.

17. The front gauge according to claim 14, further comprising:

a rotatable connection of the stop to the scale; and an angle scale that indicates degrees of rotation of the stop.

18. The front gauge according to claim 17, wherein the stop further comprises:

a stop face that is normal to the scale, and that extends both over and under the scale.

19. A method for gauging a workpiece of sheet material in a sheet bending brake, wherein the brake comprises a first longitudinally extending member forming a clamping surface, a second longitudinally extending member positioned over the first member and movable toward and away from the first member for clamping the workpiece against the clamping surface and having a longitudinal front edge forming a bending anvil, and a third longitudinally extending member pivotally mounted to the first member for bending over the bending anvil a workpiece that is clamped between the first and second members; wherein the brake is operable in any orientation and, regardless of orientation, "over" is defined to mean on the second member's side of the workpiece, "under" is defined to mean on the first member's side of the workpiece, and "front" is defined to mean a lateral outside or outward facing side of the brake, which is also the side from which the workpiece is inserted past the bending anvil into the brake; the method comprising the step of:

mounting a scale for gauging in front of the brake such that a supporting surface of the scale is in the same plane as the clamping surface of the first member;

and further comprising the step of:

attaching the scale such that it is removable and longitudinally slidable.

20. The method according to claim 19, further comprising the step of:

providing front mounting that attaches the scale to the third member.

21. The method according to claim 20, further comprising the step of:

providing one or more accessories that can be attached to the brake by the front mounting.

22. The method according to claim 21, wherein the one or more accessories are workpiece supports.

23. The method according to claim 19, further comprising the step of:

providing a static offset of the scale relative to the bending anvil.

24. The method according to claim 19, further comprising the steps of:

providing at least one gauging indicator for the scale; and providing a gauge bar with at least one scale groove or scale recess for removably and adjustably retaining a selected one of the at least one gauging indicators.

25. The method according to claim 19, further comprising the step of:

providing at least one gauging indicator that comprises ruled markings that indicate distance inward from a zero point that is a predetermined distance outward from the bending anvil.

26. The method according to claim 19, further comprising the step of:

providing at least one gauging indicator that comprises an erasable temporary marking surface with hand made marks.

27. The method according to claim 19, further comprising the step of:

mounting the scale with attachments that are adjustable for aftermarket adaptation to different brakes.

28. The method according to claim 19, further comprising the step of:

fixing an edge of the workpiece at a predetermined angle relative to the bending anvil by pressing the workpiece outward against a stop face that is slidably attached to the scale such that the stop face extends both over and under the scale in directions normal to the supporting surface of the scale.

29. The method according to claim 28, further comprising the step of:

rotatably attaching the stop face to the scale.

30. A sheet bending brake with a gauge for gauging a sheet material workpiece in the brake, wherein the brake comprises a first longitudinally extending member forming a clamping surface, a second longitudinally extending member positioned over the first member and movable toward and away from the first member for clamping a sheet material workpiece against the clamping surface and having a longitudinal front edge forming a bending anvil, and a third longitudinally extending member pivotally mounted to the first member for bending over the bending anvil a workpiece that is clamped between the first and second members; wherein the brake is operable in any orientation and, regardless of orientation, "over" is defined to mean on the second member's side of the workpiece, "under" is defined to mean on the first member's side of the workpiece, and "front" is defined to mean a lateral outside or outward facing side of the brake, which is also the side from which the workpiece is inserted past the bending anvil into the brake; the brake further comprising:

at least one scale for gauging that extends outward from the front of the sheet bending brake; and mounting that connects the at least one scale to the brake such that the at least one scale is positioned under the workpiece.

31. The brake according to claim 30, further comprising:

front mounting wherein the mounting comprises a bracket that attaches a one of the at least one scales to the third member.

32. The brake according to claim 31, wherein the mounting further comprises removable attachment of the bracket to the third member, the removable attachment comprising:

an open-ended track that extends longitudinally along at least a portion of the longitudinal extent of the third member; and a slider affixed to the bracket and slidably retainable by the track.

33. The brake according to claim 32, wherein the mounting further comprises:

a level-surfaced adapter affixed between the track and the third member; and a sliding support between the bracket and a suitable one of the track or the adapter or the third member.

34. The brake according to claim 31, further comprising:

one or more workpiece supports attached to the third member by the front mounting.

35. The brake according to claim 30, further comprising:

under-mounting wherein the mounting comprises a support bar that passes under the first and third members such that a first end of the support bar is attached to a one of the at least one scales, and an opposed second end of the support bar is attached to a frame portion of the brake.

36. The brake according to claim 35, wherein the mounting further comprises removable attachment of the support bar to the frame portion, the removable attachment comprising:

at least one square tube coupling that is affixed under the frame portion and extends laterally, the at least one coupling being sized for slidably engaging with the second end of the support bar;

at least one manually tightenable set screw in a threaded hole through the at least one coupling; and a base connecting the first end of the support bar to the one of the at least one scales.

37. The brake according to claim 36, wherein the mounting further comprises:

at least one mounting plate for affixing the at least one coupling to front and rear rails of the frame portion of the brake.

38. The brake according to claim 36, further comprising:

one or more accessories that are removably attached to the frame portion of the brake using the at least one couplings.

39. The brake according to claim 38, wherein each one of the one or more accessories is selected from the group consisting of a workpiece rack and a workpiece support.

40. The brake according to claim 39, wherein:

the workpiece rack comprises one or more vertical posts positioned rearward of the brake, each of which is affixed to a forward extending support bar at the bottom, and to at least one forward extending arm above, such that the support bar is slidably engagable with a selected one of the at least one couplings; and the workpiece support comprises a forward extending support bar affixed to a top surface that is in the same plane as the clamping surface of the first member, and the support bar is slidably engagable with a selected one of the at least one couplings.

41. The brake according to claim 36, wherein:

the mounting further comprises a stop plate affixed on the support bar near the second end such that the stop plate abuts against the at least one coupling when the support bar is slidably engaged with the at least one coupling and is positioned at a predetermined position;

each one of the at least one scales comprises a body that is slidably connected to the base;

a spring is connected between the body and the base so as to bias the body inward against the third member;

a cam plate is adjustably affixed to the third member and located at least between the body and the third member;

a bottom portion of the cam plate extends under and rearward of the third member when the third member is in an at-rest position; and first and second holes and a lockout pin fitting therethrough are provided wherein the first hole passes through the body and the second hole passes through the base such that the second hole is aligned with the first hole when the body is slid outward to a predetermined offset distance from the brake.

42. The brake according to claim 35, further comprising:

a handle extension for extending a U-shaped handle on the third member such that during pivoting movement of the third member, the extended U-shaped handle can pass around a scale that is under-mounted within the span of the extended U-shaped handle.

43. The brake according to claim 30, wherein each one of the at least one scales further comprises any combination of one or more gauging indicators including:

ruled markings that indicate distance outward from the bending anvil;

ruled markings that indicate distance inward from a zero point that is a predetermined distance outward from the bending anvil;

an erasable temporary marking surface with hand made marks; and a template strip.

44. The brake according to claim 43, wherein each one of the at least one scales further comprises:

a gauge bar with at least one scale groove or scale recess for removably and adjustably retaining a selected one of the gauging indicators.

45. The brake according to claim 30, further comprising:

a stop that is slidingly connected to a one of the at least one scales for sliding in and out;

a manually tightenable set screw in the stop; and a stop face that is normal to the one of the at least one scales, and that extends both over and under the one of the at least one scales.

46. The brake according to claim 45, further comprising:

a rotatable connection of the stop to the one of the at least one scales; and an angle scale that indicates degrees of rotation of the stop.

* * * * *